US007771011B2

(12) United States Patent
Igarashi et al.

(10) Patent No.: US 7,771,011 B2
(45) Date of Patent: Aug. 10, 2010

(54) METHOD FOR ARRANGING LIQUID DROPLET EJECTION HEADS, HEAD UNIT, LIQUID DROPLET EJECTION APPARATUS, METHOD FOR MANUFACTURING ELECTRO-OPTICAL APPARATUS, ELECTRO-OPTICAL APPARATUS, AND ELECTRONIC DEVICE

(75) Inventors: Toru Igarashi, Sakata (JP); Yuichiro Iwai, Shiojiri (JP)

(73) Assignee: Seiko Epson Corporation (JP)

( * ) Notice: Subject to any disclaimer, the term of this patent is extended or adjusted under 35 U.S.C. 154(b) by 250 days.

(21) Appl. No.: 12/125,468

(22) Filed: May 22, 2008

(65) Prior Publication Data

US 2008/0297550 A1 Dec. 4, 2008

(30) Foreign Application Priority Data

Jun. 1, 2007 (JP) ..... 2007-147284

(51) Int. Cl.
*B41J 2/15* (2006.01)

(52) U.S. Cl. ..... 347/40; 347/43; 347/12; 347/19

(58) Field of Classification Search ..... 347/12, 347/19, 40, 43

See application file for complete search history.

(56) References Cited

U.S. PATENT DOCUMENTS

| | | | | |
|---|---|---|---|---|
| 6,682,171 | B2 | 1/2004 | Otsuka | |
| 6,844,120 | B2 * | 1/2005 | Chen et al. | 430/7 |
| 6,921,148 | B2 | 7/2005 | Nakamura et al. | |
| 7,384,126 | B2 | 6/2008 | Nakamura et al. | |
| 7,399,051 | B2 * | 7/2008 | Miyasaka | 347/20 |
| 7,497,539 | B2 * | 3/2009 | Kwon et al. | 347/15 |

FOREIGN PATENT DOCUMENTS

| | | |
|---|---|---|
| JP | 2002-316420 | 10/2002 |
| JP | 2004-230660 | 8/2004 |
| JP | 2005-238821 | 9/2005 |
| JP | 2006-346575 | 12/2006 |

* cited by examiner

*Primary Examiner*—Lamson D Nguyen
(74) *Attorney, Agent, or Firm*—Harness, Dickey & Pierce, P.L.C.

(57) ABSTRACT

Provided herein is a method for arranging liquid droplet ejection heads comprising: arranging and fixing a plurality of inkjet liquid droplet ejection heads, ejecting a common functional liquid, on a common carriage plate, based on the amount of liquid droplets ejected from a number of ejecting nozzles in a nozzle row that each of the liquid droplet ejection heads has, with the heads shifted in a direction of the nozzle row, the heads being so arranged and fixed that in the heads closely aligned in the direction of the nozzle row, a difference between the amounts of liquid droplets ejected from two ejection nozzles located at each innermost end of the heads is within a predetermined range of tolerance, and the amounts of liquid droplets ejected from two ejection nozzles located at the outermost ends in the direction of the nozzle row are within a predetermined range of a reference amount.

19 Claims, 25 Drawing Sheets

X AXIS DIRECTION

STRIPE

MOSAIC

DELTA

#11 TO #170 are JETTING NOZZLES EXPECT INEFFECTIVE NOZZLES (#1 TO #10, #171 TO #180).

| HEAD | ODD-NUMBERED HEAD | | | | EVEN-NUMBERED HEAD | | | |
|---|---|---|---|---|---|---|---|---|
| | 1 (R), 3 (G), 5 (B) | | 7 (R), 9 (G), 11 (B) | | 2 (R), 4 (G), 6 (B) | | 8 (R), 10 (G), 12 (B) | |
| SECTON | #170 SIDE | #11 SIDE | #170 SIDE | #11 SIDE | #11 SIDE | #170 SIDE | #11 SIDE | #170 SIDE |

▲ JOINT BETWEEN HEADS ⟶ INNERMOST END NOZZLE CONDITION

△ JOINT BETWEEN CARRIAGES ⟶ OUTERMOST END NOZZLE CONDITION

METHOD FOR ARRANGING LIQUID DROPLET EJECTION HEADS, HEAD UNIT, LIQUID DROPLET EJECTION APPARATUS, METHOD FOR MANUFACTURING ELECTRO-OPTICAL APPARATUS, ELECTRO-OPTICAL APPARATUS, AND ELECTRONIC DEVICE

The entire disclosure of Japanese Patent Application No. 2007-147284 filed Jun. 1, 2007, is expressly incorporated by reference herein.

BACKGROUND

1. Technical Field

The present invention relates to a method for arranging liquid droplet ejection heads to arrange and fix a plurality of liquid droplet ejection heads on a common carriage plate, and relates to a head unit and a liquid droplet ejection apparatus. The invention also relates to a method for manufacturing an electro-optical apparatus, and relates to an electro-optical apparatus and an electronic device.

2. Related Art

As a known method for arranging liquid droplet ejection heads of this kind, a plurality of liquid droplet ejection heads are arranged in groups step-wise in a main scan direction, and the liquid droplet ejection heads are arranged and fixed in two groups in a sub scan direction (see JP-A-2005-238821). In this method, while all the nozzle rows of the liquid droplet ejection heads form a single drawing line, the liquid droplet ejection heads can be arranged with good space efficiency.

Upon drawing processing with a head unit produced by such an arranging method, functional liquid droplets ejected from ejection nozzles at each outermost end of separate liquid droplet ejection heads may be landed close to each other. Specifically, functional liquid droplets ejected and landed from the ejection nozzle arranged at the outermost end of one liquid droplet ejection head are landed close to functional liquid droplets ejected and landed from the ejection nozzle arranged at the outermost end of another liquid droplet ejection head. Meanwhile, liquid droplet ejection heads arranged and fixed may particularly differ in the amount of droplet ejected from each ejection nozzle due to manufacturing error. Therefore, when a plurality of liquid droplet ejection heads are simply arranged by the above-mentioned method, a difference occurs in the amount of functional liquid droplets ejected from different liquid droplet ejection heads and landed close to each other, and there has been a problem that drawing processing of good quality cannot be performed due to unevenness of color, for example.

SUMMARY

An advantage of some aspects of the invention is to provide a method for arranging liquid droplet ejection heads in which drawing quality with a plurality of liquid droplet ejection heads can be improved while permitting different liquid droplet ejection properties for each liquid droplet ejection head; a head unit and a liquid droplet ejection apparatus; a method for manufacturing an electro-optical apparatus; an electro-optical apparatus; and an electronic device.

A method for arranging liquid droplet ejection heads according to one aspect of the invention includes arranging and fixing a plurality of inkjet liquid droplet ejection heads, ejecting a common functional liquid, on a common carriage plate, based on the amount of droplets ejected from a number of ejection nozzles in a nozzle row that each of the liquid droplet ejection heads has, with the heads shifted in a direction of the nozzle row. The liquid droplet ejection heads are so arranged and fixed that in the liquid droplet ejection heads closely aligned in the direction of the nozzle row, a difference between the amounts of droplets ejected from two ejection nozzles located at each innermost end of the liquid droplet ejection heads is within a predetermined range of tolerance, and the amounts of droplets ejected from two ejection nozzles located at the outermost ends in the direction of the nozzle row on the carriage plate are within a predetermined range of a reference amount.

With the configuration, by arranging and fixing each liquid droplet ejection head so that two ejection nozzles located at each innermost end of the liquid droplet ejection heads closely aligned in the direction of the nozzle row are within the predetermined range of tolerance, the difference between the amounts of adjacent functional liquid droplets ejected and landed from different liquid droplet ejection heads can be suppressed among the liquid droplet ejection heads arranged and fixed on the common carriage plate. Furthermore, by arranging and fixing each liquid droplet ejection head so that in two ejection nozzles located at the outermost ends in the direction of the nozzle row on the carriage plate, each amount of droplets ejected is within the predetermined range of the reference amount, the difference between the amounts of adjacent functional liquid droplets ejected and landed from different liquid droplet ejection heads can be suppressed among the liquid droplet ejection heads arranged and fixed on different carriage plates. Therefore, drawing quality with a plurality of liquid droplet ejection heads can be improved while permitting different liquid droplet ejection properties for each liquid droplet ejection head.

In this case, preferably, the liquid droplet ejection heads arranged on the carriage plate are selected from candidate liquid droplet ejection heads to be arranged whose number is greater than the number of the liquid droplet ejection heads arranged on the carriage plate.

With the configuration, preparation of the number of candidate liquid droplet ejection heads greater than the number of liquid droplet ejection heads arranged will increase a possibility that the above-mentioned conditions (range of tolerance and range of the reference amount) are satisfied, and provide more groups (patterns) that satisfy the conditions. Accordingly, arrangement and fixation that satisfy the above-mentioned conditions can be easily and certainly attained, thereby improving a manufacturing yield of the liquid droplet ejection heads.

In this case, preferably, the candidate liquid droplet ejection heads has a fluctuation in the amounts of droplets ejected from all the ejection nozzles within a predetermined range.

With the configuration, by excluding candidate liquid droplet ejection heads having a fluctuation in the amounts of droplets ejected from all the ejection nozzles out of the predetermined range, appropriate arrangement can be easily attained.

Preferably, the liquid droplet ejection heads are divided into two head groups in the direction of the nozzle row and arranged on the carriage plate, and the liquid droplet ejection heads belonging to one head group and the liquid droplet ejection heads belonging to the other head group face each other in the direction of the nozzle row.

With the configuration, the liquid droplet ejection heads can be efficiently arranged on the carriage plate, and drawing processing can be efficiently performed.

In this case, preferably, the functional liquid has either color of red, green, or blue, and the predetermined range of tolerance is determined based on the difference between the amounts of droplets ejected to avoid unevenness of color possibly generated when droplets ejected and landed from two ejection nozzles are adjacent to each other.

With the configuration, the adjacent droplets (functional liquid droplets) ejected and landed from the above-mentioned two ejection nozzles located at each innermost end can provide drawing processing of good quality without unevenness of color in any of the ejected and landed adjacent droplets.

In this case, preferably, the functional liquid has either color of red, green, or blue. Furthermore, preferably, the predetermined range of the reference amount is a range having a standardized amount of droplets ejected from a single ejection nozzle as a mean value, and determined based on a range of the amount of droplets ejected to avoid unevenness of color in any of the ejected and landed adjacent droplets.

With the configuration, by determining the predetermined range of the reference amount as a range having the standardized amount of droplets ejected from a single ejection nozzle as a mean value, the above-mentioned two ejection nozzles located at each outermost end eject the amounts of droplets of a value approximated to the standardized amount of droplets ejected, thereby suppressing a fluctuation in the amount of droplets ejected. Additionally, by determining the predetermined range of the reference amount based on the range of the amount of droplets ejected to avoid unevenness of color in any of the ejected and landed adjacent droplets, drawing processing of better quality without unevenness of color can be performed.

In this case, preferably, when two or more sets of alternatives exist within the predetermined range of the reference amount, an alternative is selected with which the sum of the square of the difference between the mean value in the range of the reference amount and the amount of droplets ejected from one of the above-mentioned two ejection nozzles in each set and the square of the difference between the mean value in the range of reference amount and the amount of droplets ejected from the other of the above-mentioned two ejection nozzles in each set is the minimum.

With the configuration, by selecting a set of ejection nozzles with which the sum of the square of the difference between the mean value in the range of the reference amount and the amount of droplets ejected from one of the two ejection nozzles and the square of the difference between the mean value in the range of the reference amount and the amount of droplets ejected from the other of the above-mentioned two ejection nozzles is the minimum, the difference between the amounts of droplets ejected from the two ejection nozzles can be further suppressed, and drawing processing of better quality can be performed.

In this case, preferably, on a premise that the average amount of droplets ejected in each nozzle row is the absolute target amount of droplets ejected, the amount of droplets ejected is compared using a numeric value normalized with the absolute target amount of droplets ejected defined as 1.

With the configuration, the amount of droplets ejected can be easily compared with the absolute target amount of droplets ejected.

In this case, preferably, the amount of droplets ejected from a number of ejection nozzles in each nozzle row is calculated from an approximate characteristic line based on measurement results.

With the configuration, by calculating the amount of droplets ejected from a number of ejection nozzles in each nozzle row from the approximate characteristic line based on the measurement results of several ejection nozzles, it is not necessary to measure the amount of droplets from all the ejection nozzles, and the amounts of droplets ejected from all the ejection nozzles can be efficiently calculated.

Preferably, the approximate characteristic line is derived from the results obtained by measuring the amount of droplets from all of a plurality of ejection nozzles located at both ends of a number of ejection nozzles in each nozzle row and by excluding the amount of droplets from a plurality of remaining ejection nozzles located in an intermediate part in each nozzle row.

With the configuration, a strict value can be obtained for the ejection nozzles located at both ends of a number of ejection nozzles. Therefore, comparison of the obtained value with the range of the reference amount or the range of tolerance can be performed with sufficient precision.

In this case, preferably, the amount of droplets ejected used when comparing whether to be in within the range of tolerance is the average value of the amounts of droplets ejected from the ejection nozzles located at the ends of a number of ejection nozzles.

In this case, preferably, the amount of droplets ejected used when comparing whether to be in within the range of the reference amount is the average value of the amounts of droplets ejected from the ejection nozzles located at the ends of a number of ejection nozzles.

With the configurations, a fluctuation in the amount of droplets ejected from one ejection nozzle can be reduced, and more accurate comparison can be made to determine whether the amount of droplets ejected from the ejection nozzle is within the range of tolerance (and range of the reference amount).

In this case, preferably, each liquid droplet ejection head has a plurality of ineffective ejection nozzles not used for drawing at both ends of a number of ejection nozzle in each nozzle row.

With the configuration, since the ejection nozzles at both ends eject the amount of droplets greater than the amount of droplets from the ejection nozzles located in the intermediate part, by setting the ejection nozzles at both ends as ineffective ejection nozzles not used for drawing, a fluctuation in the amount of droplets ejected in the nozzle row can be suppressed, thereby performing drawing processing of better quality.

In a head unit according to another aspect of the invention, a plurality of liquid droplet ejection heads are arranged and fixed on a carriage plate by using the above-mentioned method for arranging liquid droplet ejection heads.

With the configuration, by using the method for arranging liquid droplet ejection heads that permits different liquid droplet ejection properties for each liquid droplet ejection head and improves drawing quality obtained by using a plurality of liquid droplet ejection heads, a head unit that allows drawing processing of good quality can be provided.

A liquid droplet ejection apparatus according to still another aspect of the invention is provided with the above-mentioned head unit used to eject a functional liquid to a workpiece for drawing.

With the configuration, by using the above-mentioned head unit, drawing processing of good quality can be performed to a workpiece.

In a method for manufacturing an electro-optical apparatus according to yet another aspect of the invention, the above-mentioned liquid droplet ejection apparatus is used to form a film with functional liquid droplets on a workpiece.

An electro-optical apparatus according to yet another aspect of the invention has a film formed on a workpiece with functional liquid droplets by using the above-mentioned liquid droplet ejection apparatus.

With the configuration, electro-optical apparatuses of high quality can be efficiently manufactured. Functional materials include luminescent materials (electro-luminescence light-emitting layers and hole injection layers) for organic electroluminescence apparatuses; filter materials (filter elements) of a color filter used for liquid crystal displays; fluorescent materials (fluorescent bodies) for electron emission devices (field emission displays, FED); fluorescent materials (fluorescent bodies) for plasma display panel (PDP) apparatuses; and electrophoresis element materials (electrophoresis bodies) for electrophoretic displays. The functional materials are liquid materials that can be ejected by functional liquid droplet ejection heads (inkjet heads). The electro-optical apparatuses (flat panel displays, FPD) include organic electroluminescence apparatuses, liquid crystal displays, electron emission devices, PDP apparatuses, and electrophoretic displays.

An electronic device according to yet another aspect of the invention is provided with an electro-optical apparatus manufactured by the above-mentioned method for manufacturing an electro-optical apparatus, or provided with the above-mentioned electro-optical apparatus.

In this case, the electronic devices denote, for example, cellular phones carrying a so-called flat-panel display and personal computers as well as various kinds of electric products.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, with reference to the accompanying drawings, a liquid droplet ejection apparatus to which a method for arranging liquid droplet ejection heads according to one embodiment of the invention is applied will be described. The liquid droplet ejection apparatus according to the present embodiment is incorporated into a production line of flat panel displays, and the liquid droplet ejection apparatus forms light emitting elements used as pixels in a color filter for liquid crystal displays or organic electroluminescence apparatuses, etc. by using functional liquid droplet ejection heads (liquid droplet ejection heads) having a functional liquid, i.e., a special ink or a luminescent resin liquid introduced therein.

Figure 1:
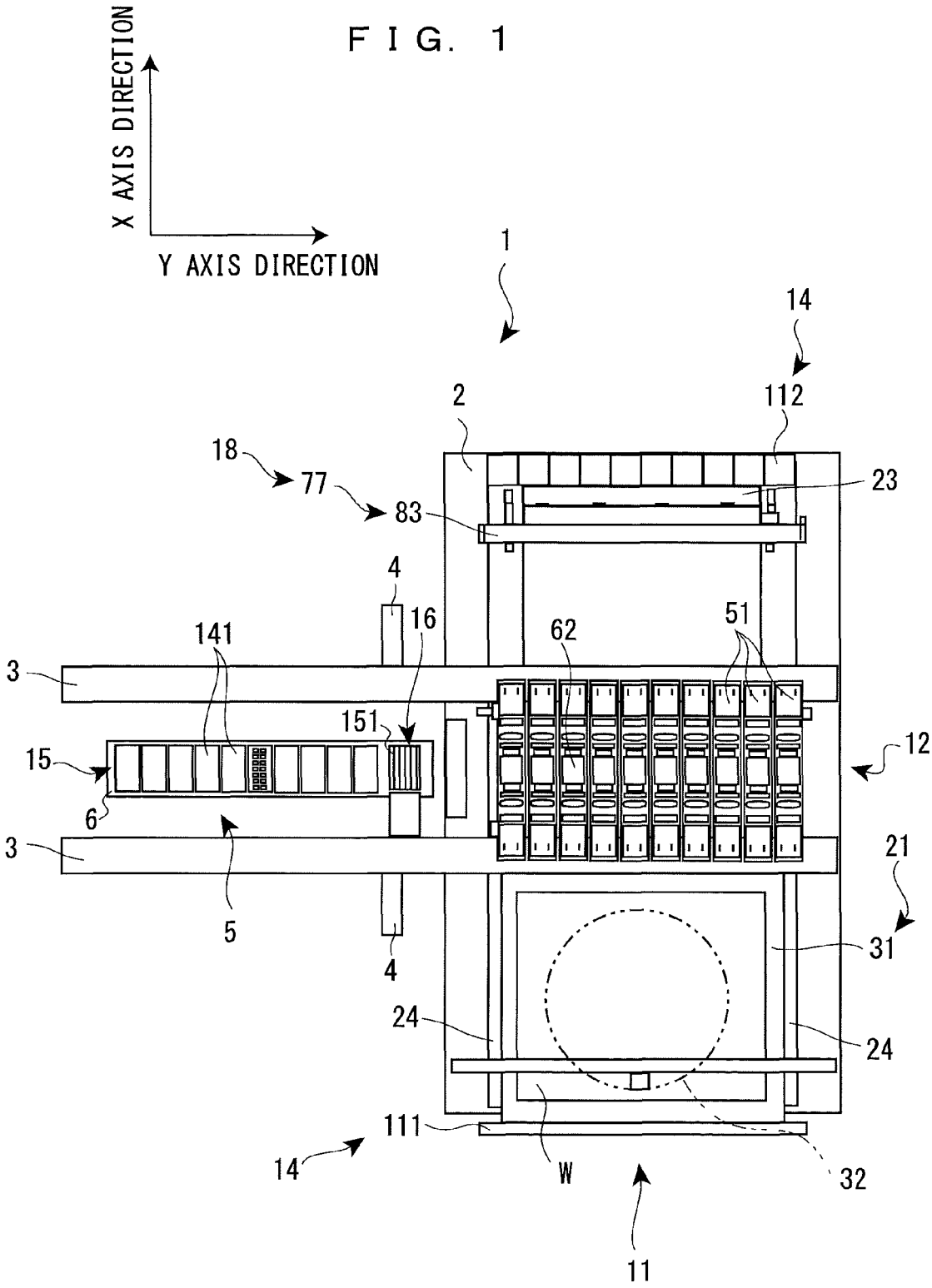
FIG. 1 is a plan view of a liquid droplet ejection apparatus according to a preferred embodiment.
Figure 2:
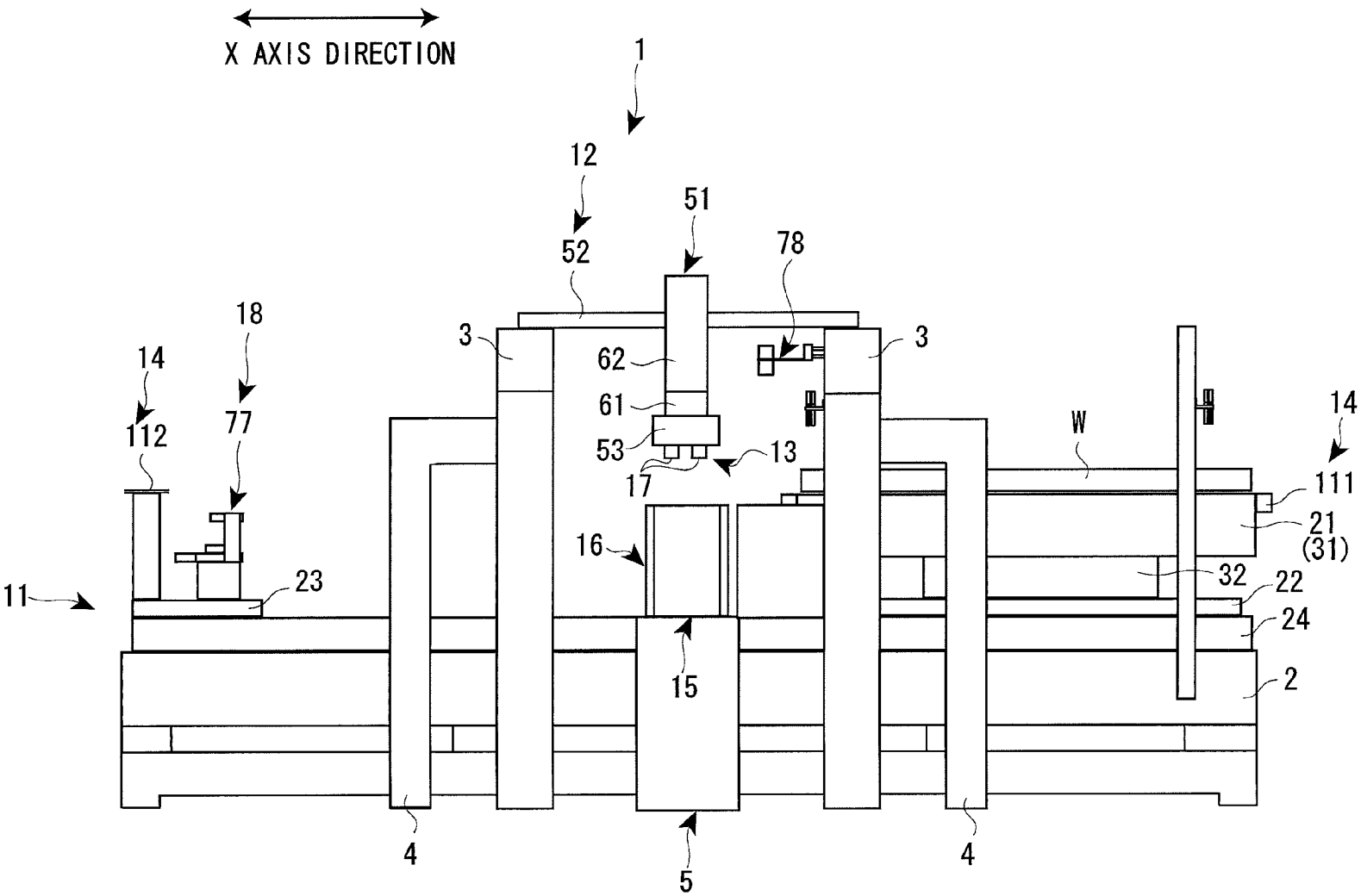
FIG. 2 is a side view of the liquid droplet ejection apparatus.

As shown in FIGS. 1 and 2, a liquid droplet ejection apparatus 1 is arranged in an X-axis supporting base 2 supported by a stone surface plate. The liquid droplet ejection apparatus 1 includes an X axis table 11 that extends in an X axis direction as a main scan direction to move a workpiece W in the X axis direction (main scan direction); a Y axis table 12 that is arranged on one pair (two) of Y-axis supporting bases 3 extended over and across the X axis table 11 with two or more supports 4 therebetween, and that extends in a Y axis direction as a sub scan direction; and 10 pieces of carriage units 51 provided with a plurality of functional liquid droplet ejection heads 17. The 10 pieces of the carriage units 51 are hung from the Y axis table 12. When driving the functional liquid droplet ejection heads 17 to eject droplets in synchronization with drive of the X axis table 11 and the Y axis table 12, functional liquid droplets of three colors of R, G, and B are ejected to draw a predetermined drawing pattern on the workpiece W.

The liquid droplet ejection apparatus 1 includes a maintenance device 5 having a flushing unit 14, a suction unit 15, a wiping unit 16, and an ejecting performance inspection unit 18. These units are used for maintenance of the functional liquid droplet ejection heads 17 to perform functional maintenance and functional recovery of the functional liquid droplet ejection heads 17. Of the respective units that constitute the maintenance device 5, the flushing unit 14 and the ejecting performance inspection unit 18 are mounted on the X axis table 11, and the suction unit 15 and the wiping unit 16 are arranged on a mount 6 deposited off the X axis table 11 and in a position to which the carriage units 51 can be moved by the Y axis table 12 (strictly, the ejecting performance inspection unit 18 has a stage unit 77 mounted on the X axis table 11 and a camera unit 78 supported by the Y-axis supporting base 3 as will be described later).

The flushing unit 14 has a pair of pre-drawing flushing units 111, 111 and a periodic flushing unit 112, and receives discharged droplets (flushing) from the functional liquid droplet ejection heads 17 discharged immediately before ejecting of the functional liquid droplet ejection heads 17 and when stopping drawing processing, for example, at the time of replacing the workpiece W. The suction unit 15 has a plurality of divided suction units 141 to forcibly suck a functional liquid from ejection nozzles 98 of each functional liquid droplet ejection head 17. The wiping unit 16 has a wiping sheet 151 to wipe off a nozzle surface 97 of the functional liquid droplet ejection head 17 after suction. The ejecting performance inspection unit 18 has a stage unit 77 provided with a check sheet 83 thereon to receive functional liquid droplets ejected from the functional liquid droplet ejection head 17, and a camera unit 78 to inspect the functional liquid droplets on the stage unit 77 according to image recognition. The ejecting performance inspection unit 18 inspects ejecting performance (ejection record, and flying course deviation of ejected droplets) of the functional liquid droplet ejection heads 17.

Hereinafter, components of the liquid droplet ejection apparatus 1 will be described. As shown in FIGS. 1 and 2, the X axis table 11 includes a set table 21 to set the workpiece W on; a first X-axis slider 22 that supports the set table 21 slidably in the X axis direction; a second X-axis slider 23 that supports the flushing unit 14 and the ejecting performance inspection unit 18 slidably in the X axis direction; a pair of right and left X-axis linear motors (not shown) that extend in the X axis direction to move the set table 21 (workpiece W) in the X axis direction through the first X-axis slider 22 and to move the flushing unit 14 and the stage unit 77 in the X axis direction with the second X-axis slider 23 therebetween; and a pair (2 pieces) of X-axis common supporting bases 24 arranged in the X-axis linear motor side by side to guide movement of the first X-axis slider 22 and the second X-axis slider 23.

The set table 21 has, for example, an adsorption table 31 to adsorb and set the workpiece W thereon, and a θ table 32 that supports the adsorption table 31 to correct a position of the workpiece W set on the adsorption table 31 in a θ axis direction. The pre-drawing flushing units 111 are attached on a pair of sides parallel with the Y axis direction of the set table 21.

The Y axis table 12 includes 10 pieces of bridge plates 52 from which 10 pieces of the carriage units 51 are hung, 10 sets of Y-axis sliders (not shown) that support 10 pieces of the bridge plates 52 at both ends thereof, and a pair of Y-axis linear motors (not shown) deposited on the pair of the Y-axis supporting bases 3 to move the bridge plates 52 in the Y axis direction with the 10 sets of Y-axis sliders therebetween. The Y axis table 12 performs a sub scan of the functional liquid droplet ejection heads 17 through each carriage unit 51 at the time of drawing, and brings the functional liquid droplet ejection heads 17 into a position facing the maintenance device 5.

Drive of the pair of Y-axis linear motors (in synchronization with each other) causes each of the Y-axis sliders to simultaneously move parallel with the Y axis direction using the pair of Y-axis supporting bases 3 as a guide. Accordingly, the bridge plates 52 move in the Y axis direction, and accordingly, the carriage units 51 move in the Y axis direction. In this case, by controlling drive of the Y-axis linear motors, each carriage unit 51 can be separated and individually moved, or the ten carriage units 51 can be moved together.

Each carriage unit 51 includes a head unit 13 having the plurality of functional liquid droplet ejection heads 17, a θ rotating mechanism 61 that supports the head unit 13 to perform θ correction (θ rotation), and a hanging member 62 that supports the head unit 13 to the Y axis table 12 (each bridge plate 52) with the θ rotating mechanism 61 therebetween.

Figure 3:
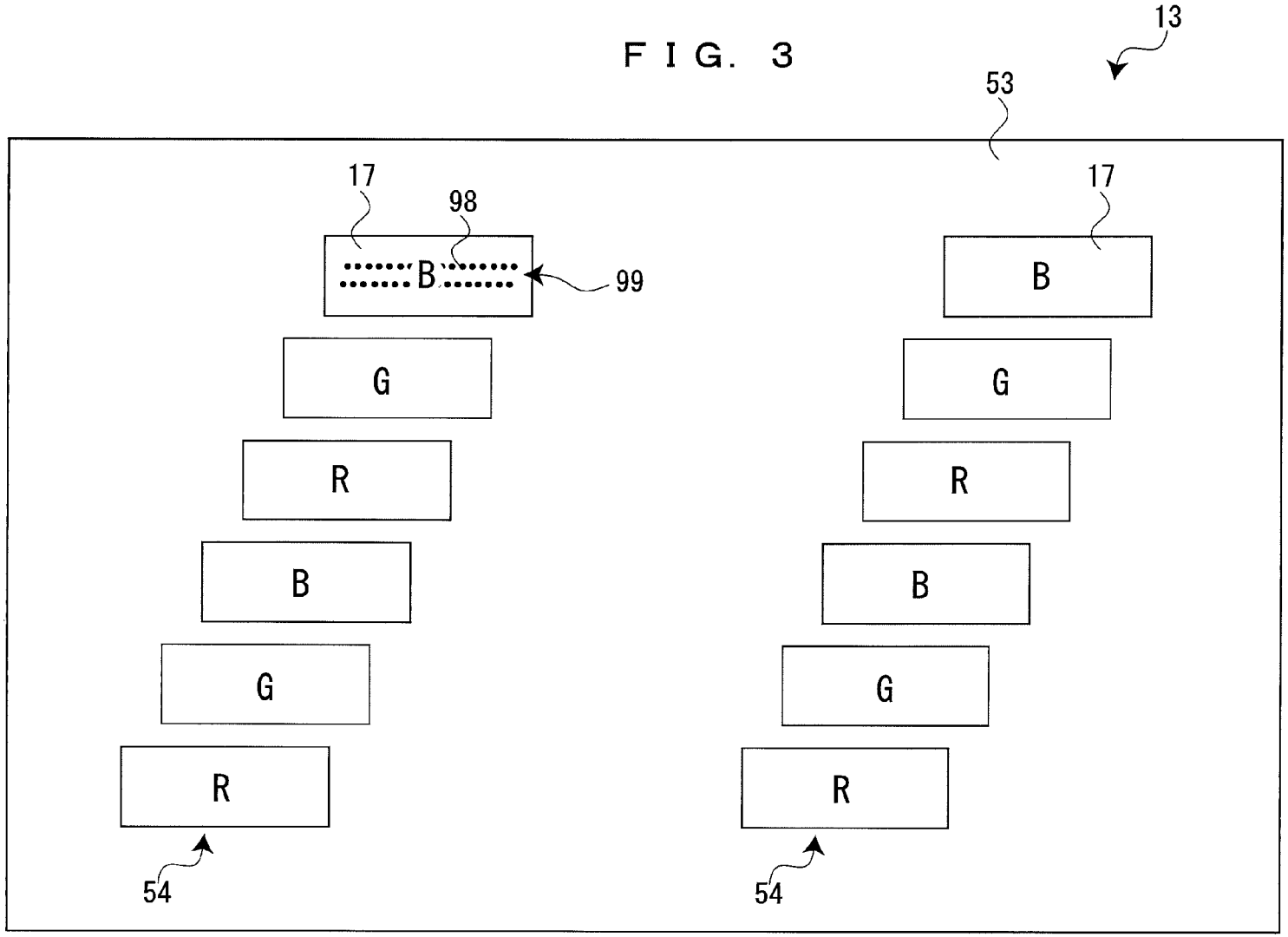
FIG. 3 is a view showing an arrangement of functional liquid droplet ejection heads mounted on a head unit.

As shown in FIG. 3, the head unit 13 includes 12 pieces of the functional liquid droplet ejection heads 17, and a carriage plate 53 on which 12 pieces of the functional liquid droplet ejection heads 17 are arranged and fixed. The 12 pieces of the functional liquid droplet ejection heads 17 are divided into two groups in the Y axis direction, and in each group, 6 pieces of the functional liquid droplet ejection heads 17 are arranged step-wise in the X axis direction to form a head group 54. The 6 pieces of the functional liquid droplet ejection heads 17 belonging to one head group 54 and those belonging to the other head group are arranged opposing each other in the direction of a nozzle row 98*b* (see FIG. 7), so that the functional liquid droplet ejection heads 17 can be efficiently arranged on the carriage plate 53 and efficient drawing processing can be performed. Furthermore, 2 pieces of the functional liquid droplet ejection heads 17 for each color in each head group 54 are aligned consecutively in the X axis direction to form a single drawing line.

Figure 4A:
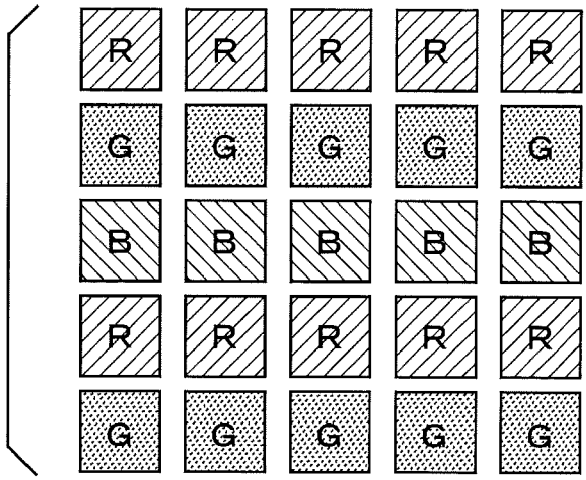
FIGS. 4A to 4C are explanatory views for arrangement patterns of a color filter, showing a stripe arrangement, a mosaic arrangement, and a delta arrangement, respectively.
Figure 4B:
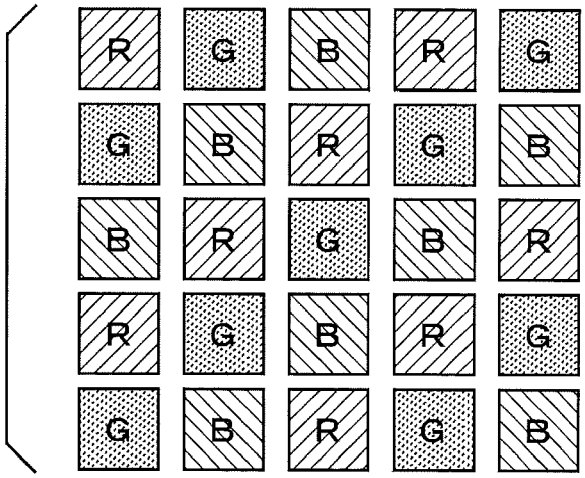
Figure 4C:
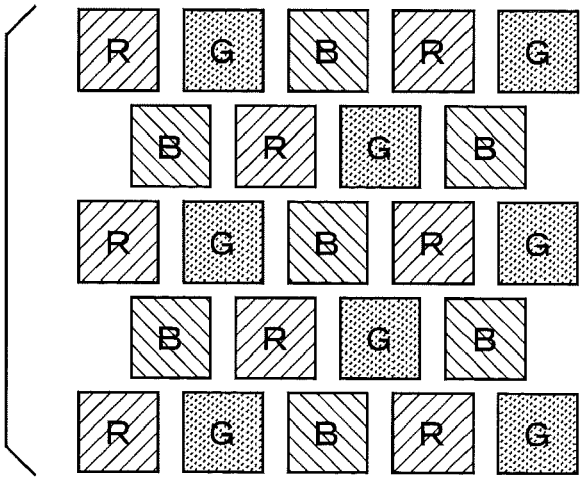

The head unit 13 has 12×10 pieces of the functional liquid droplet ejection heads 17 that corresponds to either of three colors of R, G, and B of the functional liquids, and the sets of 4 pieces of the functional liquid droplet ejection heads 17 each for one color (in each head group 54, 2 pieces of the functional liquid droplet ejection heads for each color) draw a drawing pattern on the workpiece W with the functional liquids of the three colors. In the present embodiment, by sub scanning all the functional liquid droplet ejection heads 17 (12×10 pieces) twice, drawing lines of three colors of R, G, and B continuing in the Y axis direction are formed. The length of the drawing lines is equivalent to the maximum width of the workpiece W that can be mounted on the set table 21. The drawing pattern formed of the functional liquids of the three colors has three types of patterns as shown in FIG. 4, and in the present embodiment, drawing is performed in accordance with the drawing pattern (bitmap data) shown in FIG. 4A.

Figure 5:
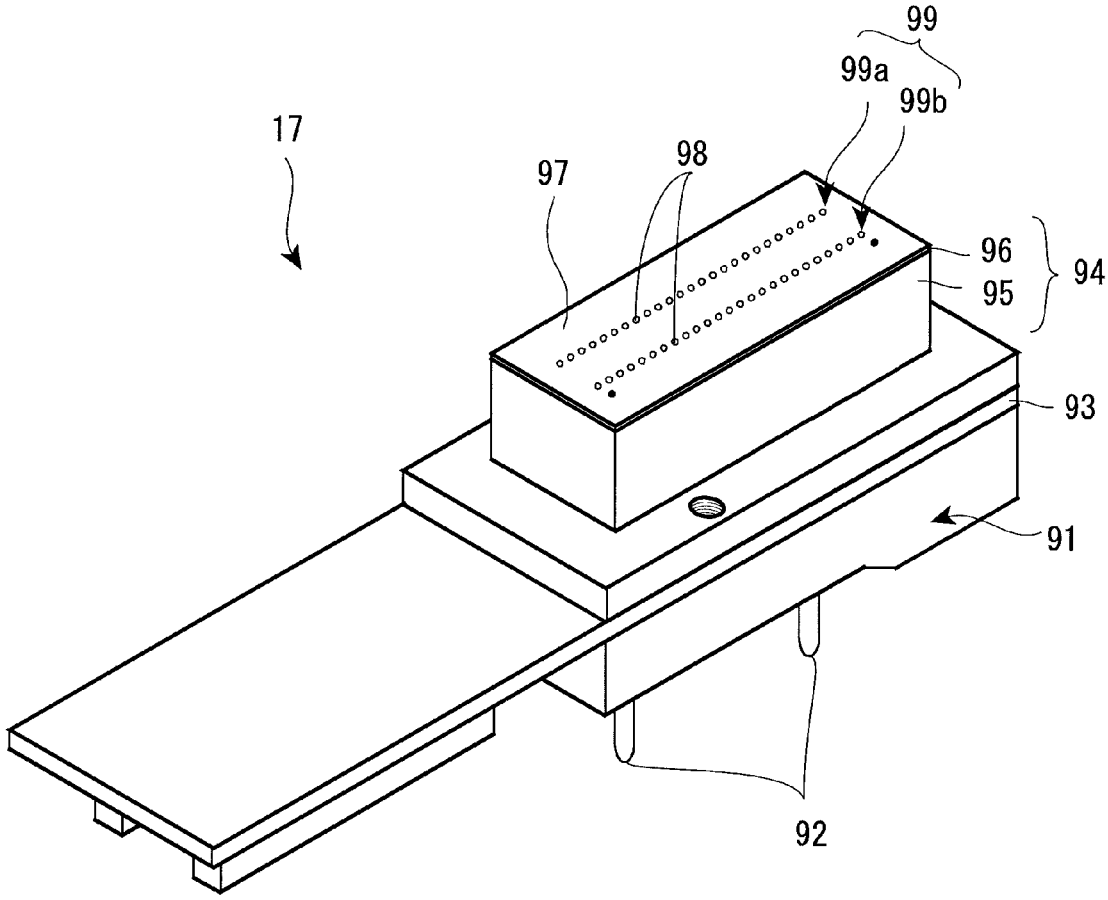
FIG. 5 is a perspective view of the functional liquid droplet ejection head.

As shown in FIG. 5, the functional liquid droplet ejection head 17 is a so-called twin type, and includes a functional liquid introductory part 91 having twin connection needles 92, twin head substrates 93 connected to the functional liquid introductory part 91, and a head body 94 connected to the lower part of the functional liquid introductory part 91 and having a head inner passage formed inside the head body 94 to be filled with the functional liquid. The connection needles 92 are connected to a functional fluid tank not shown to supply the functional liquid to the functional liquid introductory part 91. The head body 94 includes a cavity 95 (piezoelectric element) and a nozzle plate 96 where a nozzle surface 97 has openings of a number of ejection nozzles 98. When driving the functional liquid droplet ejection head 17 to eject droplets, (a voltage is applied to the piezoelectric element and) functional liquid droplets are ejected from the ejection nozzles 98 by means of a pumping action of the cavity 95.

On the nozzle surface 97, a first nozzle row 99*a* and a second nozzle row 99*b* each having a number of ejection nozzles 98 are formed parallel with each other. In addition, the position of the nozzle row 99*a* is shifted from the position of the nozzle row 99*b* by a pitch of a half of a nozzle. The two nozzle rows 99*a* and 99*b* each have 10 pieces of ineffective ejection nozzles not used for drawing processing at both ends of the nozzle rows. Accordingly, a fluctuation in the amount of droplets ejected from the nozzle rows 99*a* and 99*b* can be suppressed, and drawing processing of better quality can be performed. A "nozzle row" referred to as in claims denotes a combination of the first nozzle row 99*a* and the second nozzle row 99*b* according to the present embodiment. Therefore, hereinafter, the first nozzle row 99*a* and the second nozzle row 99*b* are collectively mentioned as a nozzle row 99.

In drawing operations of the liquid droplet ejection apparatus 1, first, the workpiece W is moved with the X axis table 11 in the X axis direction (to the upper side of FIG. 1) to perform the first drawing operation (forward movement path). Then, the head unit 13 is moved by two heads in the Y axis direction (sub scan). Again, the workpiece W is moved in the X axis direction (to the lower side of FIG. 1) to perform the second drawing operation (backward movement path). Then, an additional sub scan of the head unit 13 is performed by two heads. Once again, the workpiece W is moved in the X axis direction (to the upper side of FIG. 1) to perform the third drawing operation (forward movement path). Thus, by repeating movement of the workpiece W and the drawing operation 3 times while changing the functional liquid droplet ejection heads 17 corresponding to positions on the workpiece W by a sub scan, drawing processing of the three colors of R, G, and B is performed efficiently.

Figure 6:
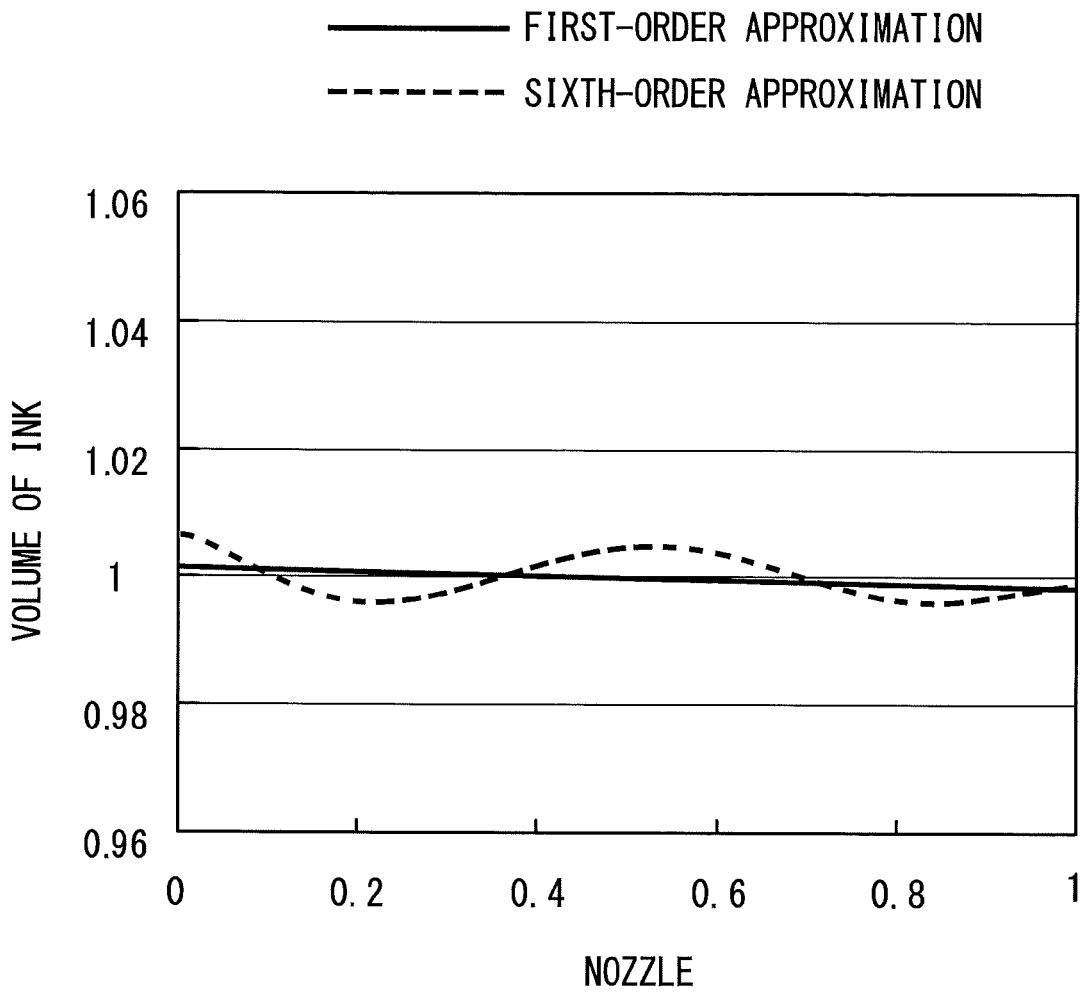
FIG. 6 is a graph of an approximate characteristic line.

Next, with reference to FIG. 6 or 7, a method for arranging the functional liquid droplet ejection heads 17 on the carriage plate 53 will be described in more detail. In arrangement of the functional liquid droplet ejection heads 17, a plurality of functional liquid droplet ejection heads 17 that serve as candidates to be arranged (hereinafter, mentioned as candidate liquid droplet ejection heads) are prepared in advance, and based on the liquid droplet ejection properties of the candidate liquid droplet ejection heads, suitable functional liquid droplet ejection heads 17 are selected out of the candidate liquid droplet ejection heads to be arranged. To this end, selection of the candidate liquid droplet ejection heads and liquid droplet ejection property acquisition of the candidate liquid droplet ejection heads will be described first. Since the liquid droplet ejection properties of the candidate liquid droplet ejection heads are acquired by liquid droplet ejection property acquisition of pre-selected liquid droplet ejection heads performed when selecting the candidate liquid droplet ejection heads, the liquid droplet ejection property acquisition of the pre-selected liquid droplet ejection heads will be described here. The following description disregards the ineffective ejection nozzles not related to drawing or measurement.

For each of the pre-selected liquid droplet ejection heads that are a number of functional liquid droplet ejection heads 17 manufactured and pre-selected, the amount of ejecting, ejecting velocity, and poor ejecting of each ejection nozzle 98 are measured using test equipment not shown. Particularly, the amount of droplet ejected from a plurality of ejection nozzles 98 at both ends is all measured, whereas the amount of droplet ejected from remaining ejection nozzles 98 (a plurality of ejection nozzles 98 located in an intermediate part) is calculated using an approximate characteristic line (see FIG. 6) based on measurement results of the ejection nozzles 98 at both ends. Thus, by calculating the amounts of droplets ejected from all the ejection nozzles 98 in each nozzle row 99 from the approximate characteristic line based on the measurement results of several ejection nozzles 98, it is not necessary to measure the amount of droplets from all of the ejection nozzles 98, and the amounts of droplets ejected from all the ejection nozzles 98 can be efficiently calculated. Additionally, by making the approximate characteristic line based on the measurement results of the ejection nozzles 98 at both ends, strict values can be obtained for the ejection nozzles 98 at both ends used to arrange and fix the functional liquid droplet ejection head 17. Preferably, a 6th-order approximated curve is used as the approximate characteristic line. The above-mentioned poor ejecting of droplets includes non-ejecting, flying course deviation, unusual ejecting, etc.

Next, based on the measured liquid droplet ejection properties, the candidate liquid droplet ejection heads are selected from a number of pre-selected liquid droplet ejection heads. Specifically, when in a single pre-selected liquid droplet ejection head, a fluctuation in the amounts of droplets ejected from all the ejection nozzles 98 is determined to be within a predetermined range, and when the pre-selected liquid droplet ejection head is determined to have good quality based on judgment of ejecting velocity, flying course deviation, etc., the pre-selected liquid droplet ejection head is selected as a candidate liquid droplet ejection head. Thus, by setting a condition that a fluctuation in the amounts of droplets ejected from all the ejection nozzles 98 is within the predetermined range as a criterion, appropriate arrangement of the functional liquid droplet ejection heads 17 can be made with ease. The selected candidate liquid droplet ejection heads that are greater in number than the functional liquid droplet ejection heads 17 to be arranged are prepared. Accordingly, the possibility is raised that conditions used to arrange and fix the functional liquid droplet ejection heads 17 will be satisfied, and more groups (patterns) that satisfy the conditions can be provided. Therefore, the manufacturing yield of the functional liquid droplet ejection heads 17 is improved, and the functional liquid droplet ejection heads 17 can be easily and certainly arranged and fixed in accordance with the conditions.

Figure 7:
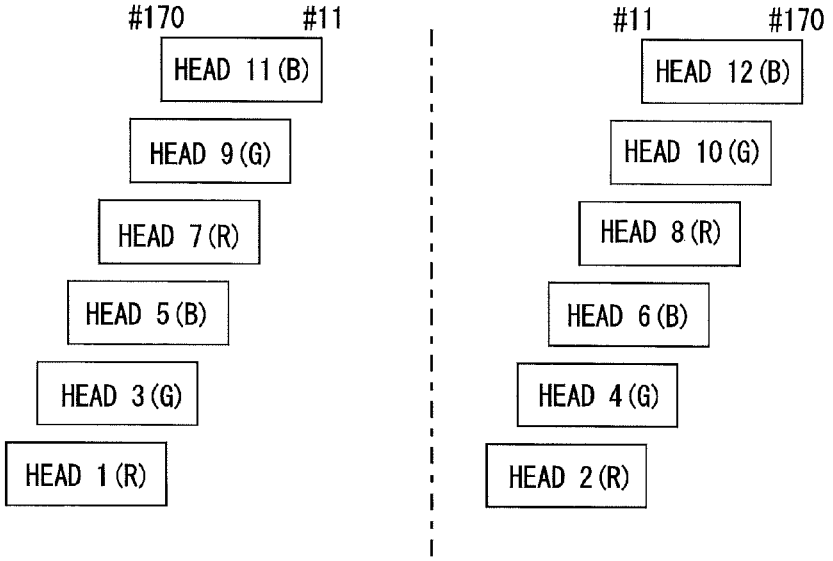
FIG. 7 is an explanatory view for an arrangement of the functional liquid droplet ejection heads on a carriage plate.

As shown in FIG. 7, the functional liquid droplet ejection heads 17 are so arranged and fixed that two conditions, an innermost end nozzle condition and an outermost end nozzle condition, are satisfied. These conditions are taken into consideration for each color of the functional liquid. Therefore, red is used as an example here for description.

The innermost end nozzle condition is a condition that in 4 pieces (for each color) of the functional liquid droplet ejection heads 17 on the carriage plate 53, for each set of two ejection nozzles 98 located at the innermost ends in the functional liquid droplet ejection heads 17 closely aligned in the direction of the nozzle row 99, the difference between the amounts of droplets ejected from the two ejection nozzles 98 is within a predetermined range of tolerance. The range of tolerance is set based on the difference between the amounts of droplets ejected to avoid unevenness of color in any of ejected and landed droplets when the ejected and landed droplets (landed functional liquid droplets) are adjacent to each other. For example, in the present embodiment, the difference between the amounts of droplets ejected is up to a tolerance of 0.65% (0.65% of a standard value 1.011 pl).

The outermost end nozzle condition is a condition that in the functional liquid droplet ejection heads 17 located at both outermost ends in the direction of the nozzle row 99 on the carriage plate 53, for two ejection nozzles 98 arranged at the outermost ends of the above-mentioned functional liquid droplet ejection heads 17, that is, for the ejection nozzle 98 at the rightmost end of the functional liquid droplet ejection head 17 and the ejection nozzle 98 at the leftmost end of the functional liquid droplet ejection head 17, each amount of droplet ejected from the two ejection nozzles 98 is within a predetermined range of a reference amount. The range of the reference amount is a range having the standardized amount of droplets ejected from a single ejection nozzle 98 as a mean value, and set based on the range of the amount of droplets ejected to avoid unevenness of color in any of the ejected and landed adjacent droplets. For example, in the present embodiment, the range of reference amount is 1.011 pl±0.45% (0.45% of the standard value 1.011 pl).

Thus, by arranging and fixing each functional liquid droplet ejection head 17 so that the two ejection nozzles 98 located at the innermost ends of the functional liquid droplet ejection heads 17 closely aligned in the direction of the nozzle row 99 have the amount of droplets ejected within the predetermined range of tolerance, the difference between the amounts of adjacent droplets ejected and landed from the different functional liquid droplet ejection heads 17 can be suppressed among the functional liquid droplet ejection heads 17 arranged and fixed on the common carriage plate 53. Furthermore, by arranging and fixing each functional liquid droplet ejection head 17 so that in the two ejection nozzles located at the outermost ends in the direction of the nozzle row 99 on the carriage plate 53, each amount of droplets ejected is within the predetermined range of the reference amount, the difference between the amounts of adjacent droplets (functional liquid droplets) ejected and landed from the different functional liquid droplet ejection heads 17 can be suppressed among the functional liquid droplet ejection heads 17 arranged and fixed on different carriage plates 53. Therefore, while liquid droplet ejection properties different for each functional liquid droplet ejection head 17 are permitted, drawing quality obtained by using the plurality of functional liquid droplet ejection heads 17 can be improved.

Furthermore, on the innermost end nozzle condition, the range of tolerance is set based on the difference between the amounts of droplets ejected to avoid unevenness of color generated when the ejected and landed droplets are adjacent to each other. Accordingly, in the adjacent ejected and landed droplets ejected from the two ejection nozzles 98 located at the innermost ends, drawing processing of better quality without unevenness of color can be performed.

Furthermore, on the outermost end nozzle condition, the range of the reference amount is so determined that the standardized amount of droplets ejected from a single ejection nozzle is set as the mean value, and then, the range has a value approximated to the standardized amount of droplets ejected. Therefore, a fluctuation in the amount of droplets ejected can be suppressed. In addition, the range of the reference amount is determined based on the range of the amount of droplets ejected to avoid unevenness of color in any of the ejected and landed adjacent droplets, whereby drawing processing of better quality without unevenness of a color can be performed.

On the outermost end nozzle condition, when two or more sets of alternatives exist within the predetermined range of the reference amount, an alternative is selected wherein the sum of the square of the difference between the mean value (standard value) in the range of the reference amount in each set and the amount of droplets ejected from one ejection nozzle 98 at the outermost ends and the square of the difference between the mean value and the amount of droplets ejected from the other ejection nozzle 98 at the outermost ends is the minimum. Accordingly, the difference between the amounts of droplets ejected from the two ejection nozzles 98 can be further suppressed, and drawing processing of better quality can be performed. For example, when the mean value is 1.011 pl and there are 2 sets of alternatives, two ejection nozzles of one set eject amounts of droplets of 1.011+0.5 pl and 1.011−0.1 pl, and two ejection nozzles of the other set eject amounts of droplets of 1.011+0.3 pl and 1.011−0.2 pl, the sum of the square the difference between the mean value and one amount of droplets ejected and the square of the difference between the mean value and the other amount of droplets ejected in the one set is $(1.011-(1.011+0.5))^2+(1.011-(1.011-0.1))^2=0.26$; and the sum of the square of the difference between the mean value and one amount of droplets ejected and the square of the difference between the mean value and the other amount of droplets ejected in the other set is $(1.011-(1.011+0.3))^2+(1.011-(1.011-0.2))^2=0.13$. Therefore, in this case, the other set having the minimum of 0.13 is selected.

Preferably, on the premise that the average amount of droplets ejected from each nozzle row 99 is an absolute target amount of droplets ejected, the amount of droplets ejected used for these conditions is a numeric value normalized with the absolute target amount of droplets ejected defined as 1. Accordingly, the amount of droplets ejected with the absolute target amount of droplets ejected can be easily compared.

Preferably, the amount of droplets ejected used when comparing whether to be within the range of tolerance or the range of the reference amount is an average value of the amounts of droplets ejected from a plurality (10 pieces each) of ejection nozzles 98 located at the ends of the nozzle rows 99. In other words, the average value is defined as an amount of droplets ejected from each ejection nozzle 98 used for the above-mentioned comparison. Accordingly, a fluctuation in the amount of droplets ejected from one ejection nozzle 98 reduces, allowing more accurate comparison of whether to be within the range of the reference amount. Preferably, when selecting an alternative under the above-mentioned outermost end nozzle condition, the sum of the square of the difference between 5 ejection nozzles located at one outermost end and the mean value and the square of the difference between another 5 ejection nozzles located at the other outermost end and the mean value is used as the value to be compared.

With the above-mentioned configuration, by arranging and fixing each functional liquid droplet ejection head 17 so that the two ejection nozzles 98 located at the innermost ends of the functional liquid droplet ejection heads 17 closely aligned in the direction of the nozzle row 99 have the amount of droplets ejected within the predetermined range of tolerance, the difference between the amounts of adjacent droplets ejected and landed from the different functional liquid droplet ejection heads 17 can be suppressed among the functional liquid droplet ejection heads 17 arranged and fixed on the common carriage plate 53. Furthermore, by arranging and fixing each functional liquid droplet ejection head 17 so that in the two ejection nozzles located at the outermost ends in the direction of the nozzle row 99 on the carriage plate 53, each amount of droplets ejected is within the predetermined range of the reference amount, the difference between the amounts of adjacent functional liquid droplets ejected and landed from the different functional liquid droplet ejection heads 17 can be suppressed among the functional liquid droplet ejection heads 17 arranged on and fixed to different carriage plates 53. Therefore, while liquid droplet ejection properties different for each functional liquid droplet ejection head 17 are permitted, drawing quality obtained by using the plurality of functional liquid droplet ejection heads 17 can be improved.

Taking electro-optical apparatuses (flat panel display apparatuses) manufactured using the liquid droplet ejection apparatus 1 and active matrix substrates formed on the electro-optical apparatuses as display apparatuses as examples, configurations and manufacturing methods thereof will now be described. Examples of the electro-optical apparatuses include a color filter, a liquid crystal display apparatus, an organic EL apparatus, a plasma display apparatus (PDP (plasma display panel) apparatus), and an electron emission apparatus (FED (field emission display) apparatus and SED (surface-conduction electron emitter display) apparatus). Note that the active matrix substrate includes thin-film transistors, source lines and data lines which are electrically connected to the thin film transistors.

Figure 8:
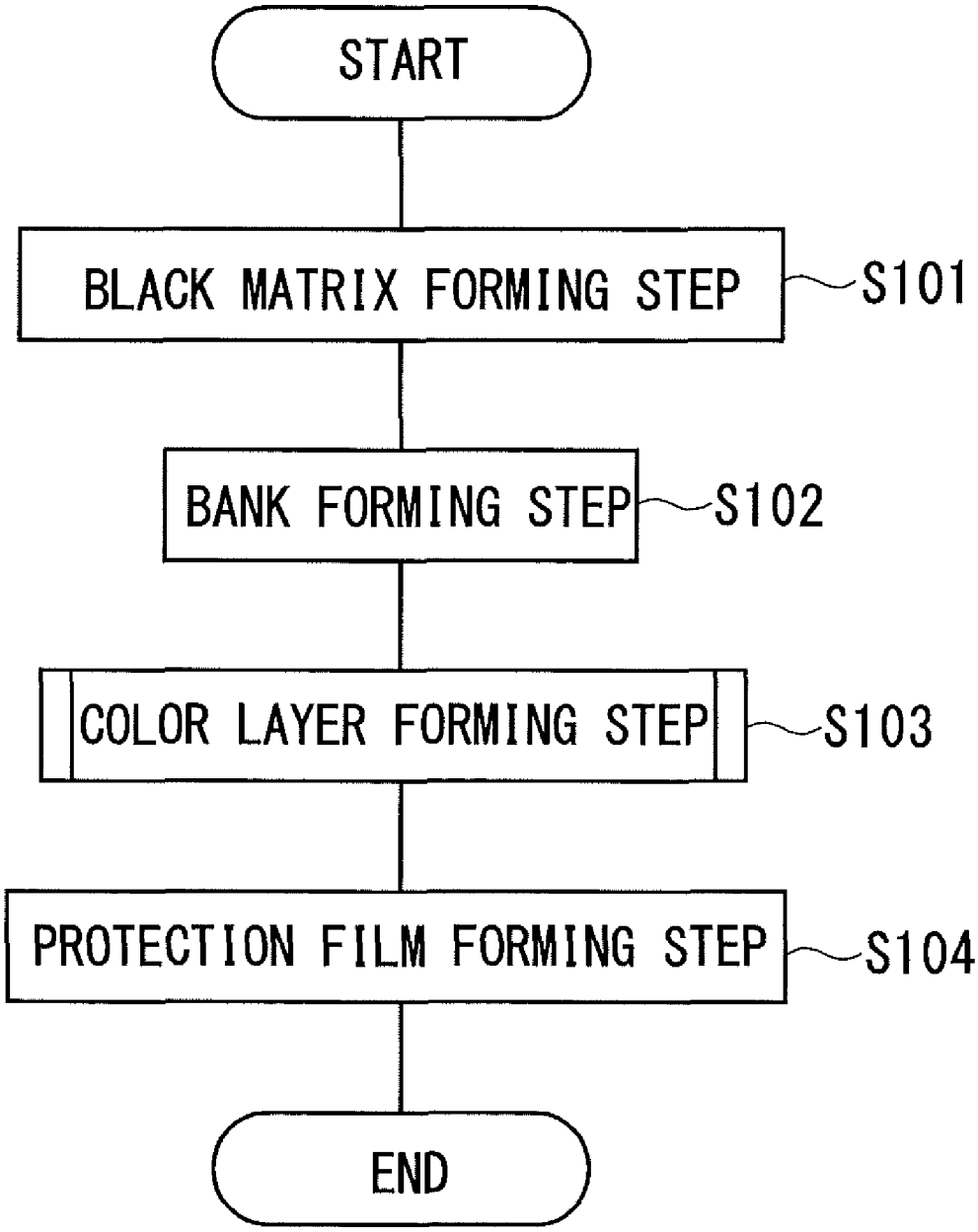
FIG. 8 is a flowchart illustrating manufacturing steps of a color filter.

First, a manufacturing method of a color filter incorporated in a liquid crystal display apparatus or an organic EL apparatus will be described. FIG. 8 shows a flowchart illustrating manufacturing steps of a color filter. FIGS. 12A to 12E are sectional views of the color filter 500 (a filter substrate 500A) of this embodiment shown in an order of the manufacturing steps.

Figure 9A:
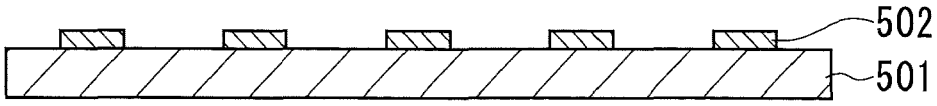
FIGS. 9A-9E are schematic sectional views in an order of manufacturing process for the color filter.

In a black matrix forming step (step S101), as shown in FIG. 9A, a black matrix 502 is formed on the substrate (W) 501. The black matrix 502 is formed of a chromium metal, a laminated body of a chromium metal and a chromium oxide, or a resin black, for example. The black matrix 502 may be formed of a thin metal film by a sputtering method or a vapor deposition method. Alternatively, the black matrix 502 may be formed of a thin resin film by a gravure plotting method, a photoresist method, or a thermal transfer method.

Figure 9B:
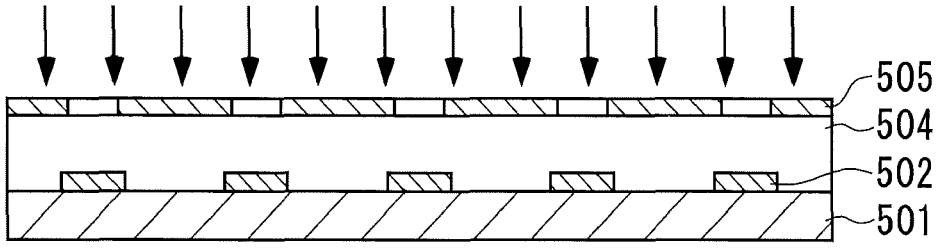

In a bank forming step (step S102), the bank 503 is formed so as to be superposed on the black matrix 502. Specifically, as shown in FIG. 9B, a resist layer 504 which is formed of a transparent negative photosensitive resin is formed so as to cover the substrate 501 and the black matrix 502. An upper surface of the resist layer 504 is covered with a mask film 505 formed in a matrix pattern. In this state, exposure processing is performed.

Figure 9C:
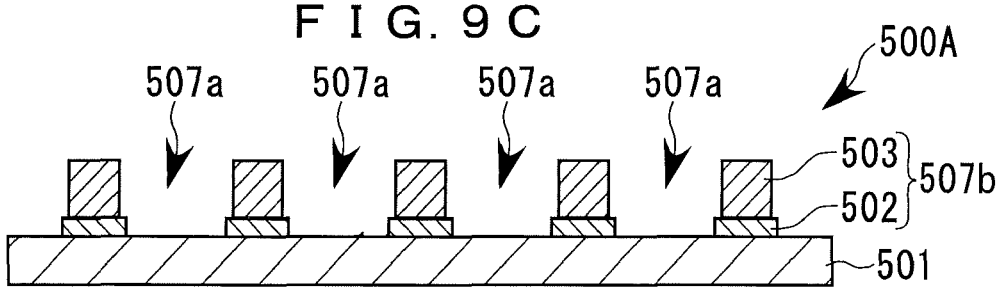

Furthermore, as shown in FIG. 9C, the resist layer 504 is patterned by performing etching processing on portions of the resist layer 504 which are not exposed, and the bank 503 is thus formed. Note that when the black matrix 502 is formed of a resin black, the black matrix 502 also serves as a bank.

The bank 503 and the black matrix 502 disposed beneath the bank 503 serve as a partition wall 507*b* for partitioning the pixel areas 507*a*. The partition wall 507*b* defines receiving areas for receiving the functional liquid ejected when the functional liquid droplet ejection heads 17 form coloring layers (film portions) 508R, 508G, and 508B in a subsequent coloring layer forming step.

The filter substrate 500A is obtained through the black matrix forming step and the bank forming step.

Note that, in this embodiment, a resin material having a lyophobic (hydrophobic) film surface is used as a material of the bank 503. Since a surface of the substrate (glass substrate) 501 is lyophilic (hydrophilic), variation of positions to which the liquid droplet is projected in the each of the pixel areas 507*a* surrounded by the bank 503 (partition wall 507*b*) can be automatically corrected in the subsequent coloring layer forming step.

Figure 9D:
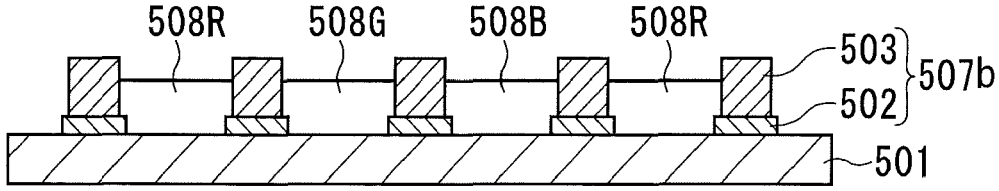
Figure 9E:
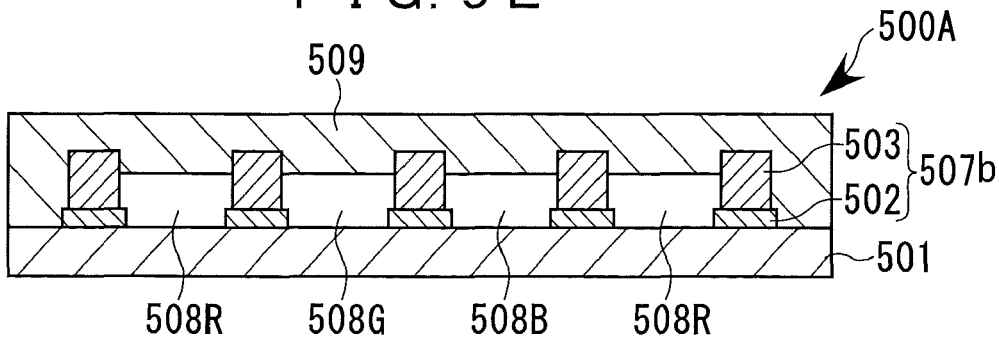

In the coloring layer forming step (S103), as shown in FIG. 9D, the functional liquid droplet ejection heads 17 eject the functional liquid within the pixel areas 507*a* each of which are surrounded by the partition wall 507*b*. In this case, the functional liquid droplet ejection heads 17 eject functional liquid droplets using functional liquids (filter materials) of colors R, G, and B. A color scheme pattern of the three colors R, G, and B may be the stripe arrangement, the mosaic arrangement, or the delta arrangement.

Then drying processing (such as heat treatment) is performed so that the three color functional liquids are fixed, and thus three coloring layers 508R, 508G, and 508B are formed. Thereafter, a protective film forming step is reached (step S104). As shown in FIG. 12E, a protective film 509 is formed so as to cover surfaces of the substrate 501, the partition wall 507*b*, and the three coloring layers 508R, 508G, and 508B.

That is, after liquid used for the protective film is ejected onto the entire surface of the substrate 501 on which the coloring layers 508R, 508G, and 508B are formed and the drying process is performed, the protective film 509 is formed.

In the manufacturing method of the color filter 500, after the protective film 509 is formed, a coating step is performed in which ITO (Indium Tin Oxide) serving as a transparent electrode in the subsequent step is coated.

Figure 10:
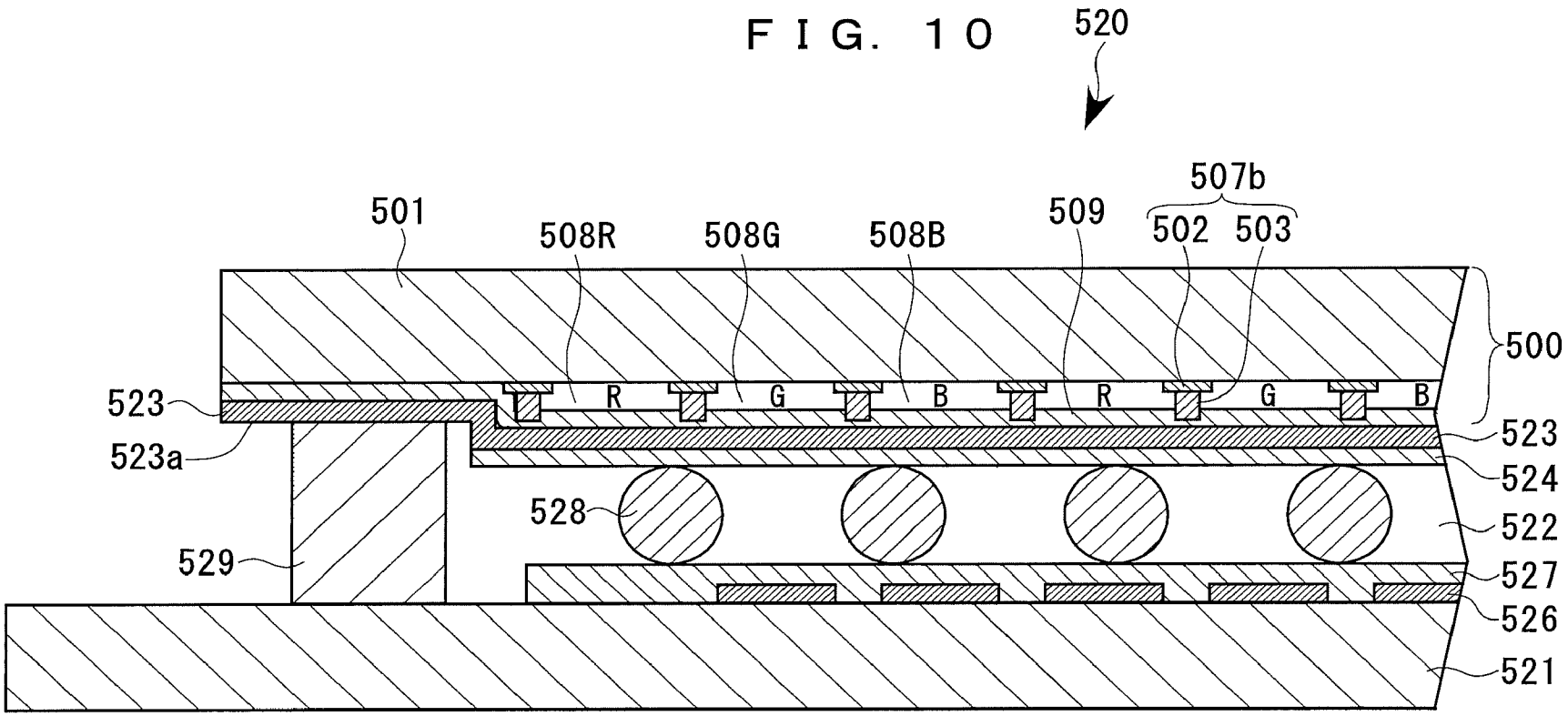
FIG. 10 is a sectional view of an essential part of a liquid crystal display using the color filter according to the invention.

FIG. 10 is a sectional view of an essential part of a passive matrix liquid crystal display apparatus (liquid crystal display apparatus 520) and schematically illustrates a configuration thereof as an example of a liquid crystal display apparatus employing the color filter 500. A transmissive liquid crystal display apparatus as a final product can be obtained by disposing a liquid crystal driving IC (integrated circuit), a backlight, and additional components such as supporting members on the display apparatus 520. Note that the color filter 500 is the same as that shown in FIGS. 9A to 9E, and therefore, reference numerals the same as those used in FIGS. 9A to 9E to denote the same components, and descriptions thereof are omitted.

The display apparatus 520 includes the color filter 500, a counter substrate 521 such as a glass substrate, and a liquid crystal layer 522 formed of STN (super twisted nematic) liquid crystal compositions sandwiched therebetween. The color filter 500 is disposed on the upper side of FIG. 10 (on an observer side).

Although not shown, polarizing plates are disposed so as to face an outer surface of the counter substrate 521 and an outer surface of the color filter 500 (surfaces which are remote from the liquid crystal layer 522). A backlight is disposed so as to face an outer surface of the polarizing plate disposed near the counter substrate 521.

A plurality of rectangular first electrodes 523 extending in a horizontal direction in FIG. 10 are formed with predetermined intervals therebetween on a surface of the protective film 509 (near the liquid crystal layer 522) of the color filter 500. A first alignment layer 524 is arranged so as to cover surfaces of the first electrodes 523 which are surfaces remote from the color filter 500.

On the other hand, a plurality of rectangular second electrodes 526 extending in a direction perpendicular to the first electrodes 523 disposed on the color filter 500 are formed with predetermined intervals therebetween on a surface of the counter substrate 521 which faces the color filter 500. A second alignment layer 527 is arranged so as to cover surfaces of the second electrodes 526 near the liquid crystal layer 522. The first electrodes 523 and the second electrodes 526 are formed of a transparent conductive material such as an ITO.

A plurality of spacers 528 disposed in the liquid crystal layer 522 are used to maintain the thickness (cell gap) of the liquid crystal layer 522 constant. A seal member 529 is used to prevent the liquid crystal compositions in the liquid crystal layer 522 from leaking to the outside. Note that an end of each of the first electrodes 523 extends beyond the seal member 529 and serves as wiring 523*a*.

Pixels are arranged at intersections of the first electrodes 523 and the second electrodes 526. The coloring layers 508R, 508G, and 508B are arranged on the color filter 500 so as to correspond to the pixels.

In normal manufacturing processing, the first electrodes 523 are patterned and the first alignment layer 524 is applied on the color filter 500 whereby a first half portion of the display apparatus 520 on the color filter 500 side is manufactured. Similarly, the second electrodes 526 are patterned and the second alignment layer 527 is applied on the counter substrate 521 whereby a second half portion of the display apparatus 520 on the counter substrate 521 side is manufactured. Thereafter, the spacers 528 and the seal member 529 are formed on the second half portion, and the first half portion is attached to the second half portion. Then, liquid crystal to be included in the liquid crystal layer 522 is injected from an inlet of the seal member 529, and the inlet is sealed. Finally, the polarizing plates and the backlight are disposed.

The liquid droplet ejection apparatus 1 of this embodiment may apply a spacer material (functional liquid) constituting the cell gap, for example, and uniformly apply liquid crystal (functional liquid) to an area sealed by the seal member 529 before the first half portion is attached to the second half portion. Furthermore, the seal member 529 may be printed using the functional liquid droplet ejection heads 17. Moreover, the first alignment layer 524 and the second alignment layer 527 may be applied using the functional liquid droplet ejection heads 17.

Figure 11:
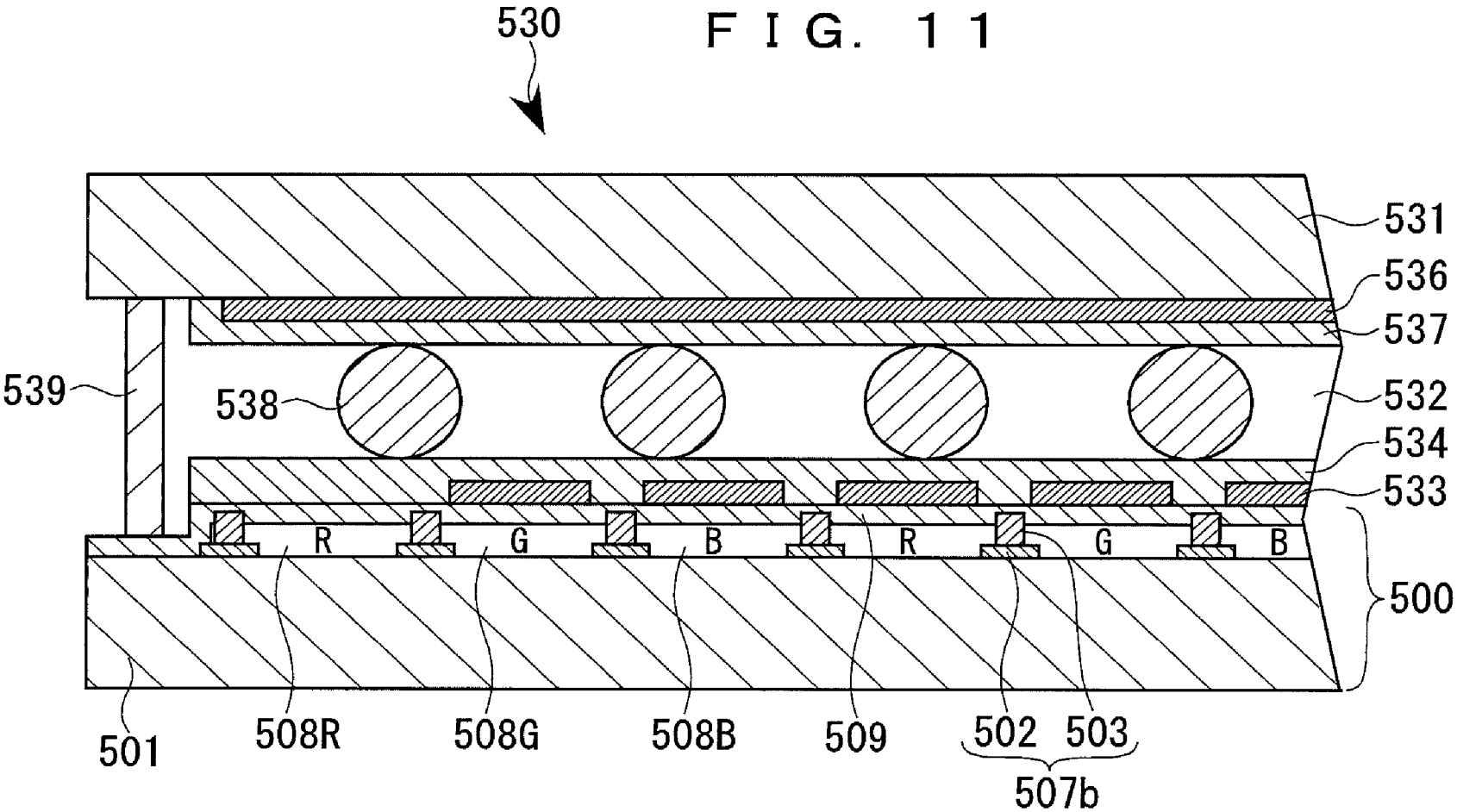
FIG. 11 is a sectional view of an essential part of a liquid crystal display as the second example using the color filter according to the invention.

FIG. 11 is a sectional view of an essential part of a display apparatus 530 and schematically illustrates a configuration thereof as a second example of a liquid crystal display apparatus employing the color filter 500 which is manufactured in this embodiment.

The display apparatus 530 is considerably different from the display apparatus 520 in that the color filter 500 is disposed on a lower side in FIG. 11 (remote from the observer).

The display apparatus 530 is substantially configured such that a liquid crystal layer 532 constituted by STN liquid crystal is arranged between the color filter 500 and a counter substrate 531 such as a glass substrate. Although not shown, polarizing plates are disposed so as to face an outer surface of the counter substrate 531 and an outer surface of the color filter 500.

A plurality of rectangular first electrodes 533 extending in a depth direction of FIG. 11 are formed with predetermined intervals therebetween on a surface of the protective film 509 (near the liquid crystal layer 532) of the color filter 500. A first alignment layer 534 is arranged so as to cover surfaces of the first electrodes 533 which are surfaces near the liquid crystal layer 532.

On the other hand, a plurality of rectangular second electrodes 536 extending in a direction perpendicular to the first electrodes 533 disposed on the color filter 500 are formed with predetermined intervals therebetween on a surface of the counter substrate 531 which faces the color filter 500. A second alignment layer 537 is arranged so as to cover surfaces of the second electrodes 536 near the liquid crystal layer 532.

A plurality of spacers 538 disposed in the liquid crystal layer 532 are used to maintain the thickness (cell gap) of the liquid crystal layer 532 constant. A seal member 539 is used to prevent the liquid crystal compositions in the liquid crystal layer 532 from leaking to the outside.

As with the display apparatus 520, pixels are arranged at intersections of the first electrodes 533 and the second electrodes 536. The coloring layers 508R, 508G, and 508B are arranged on the color filter 500 so as to correspond to the pixels.

Figure 12:
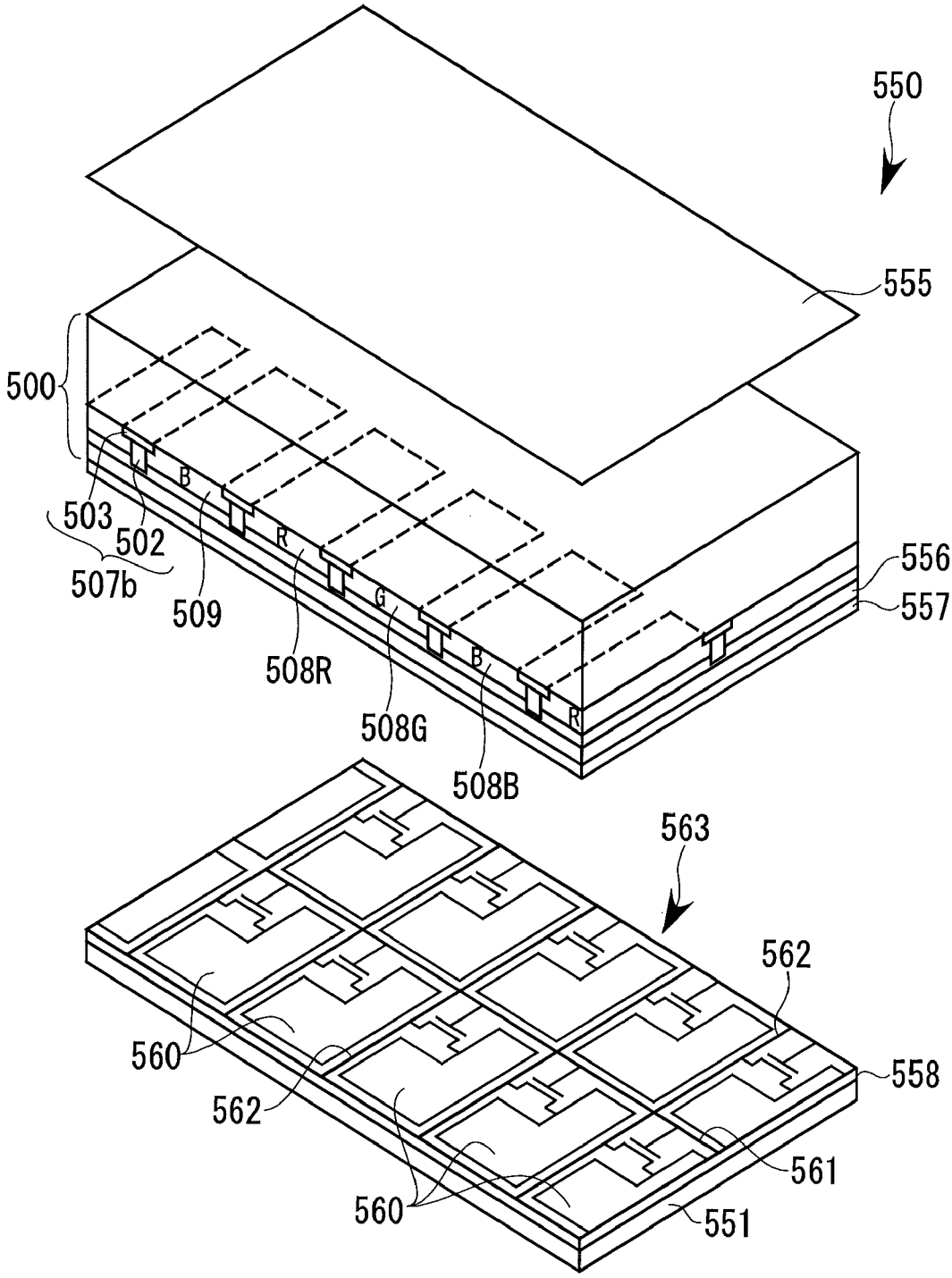
FIG. 12 is a sectional view of an essential part of a liquid crystal display as the third example using the color filter according to the invention.

FIG. 12 is an exploded perspective view of a transmissive TFT (thin film transistor) liquid crystal display device and schematically illustrates a configuration thereof as a third example of a liquid crystal display apparatus employing the color filter 500 to which the invention is applied.

A liquid crystal display apparatus 550 has the color filter 500 disposed on the upper side of FIG. 12 (on the observer side).

The liquid crystal display apparatus 550 includes the color filter 500, a counter substrate 551 disposed so as to face the color filter 500, a liquid crystal layer (not shown) interposed therebetween, a polarizing plate 555 disposed so as to face an upper surface of the color filter 500 (on the observer side), and a polarizing plate (not shown) disposed so as to face a lower surface of the counter substrate 551.

An electrode 556 used for driving the liquid crystal is formed on a surface of the protective film 509 (a surface near the counter substrate 551) of the color filter 500. The electrode 556 is formed of a transparent conductive material such as an ITO and entirely covers an area in which pixel electrodes 560 are to be formed which will be described later. An alignment layer 557 is arranged so as to cover a surface of the electrode 556 remote from the pixel electrode 560.

An insulating film 558 is formed on a surface of the counter substrate 551 which faces the color filter 500. On the insulating film 558, scanning lines 561 and signal lines 562 are arranged so as to intersect with each other. Pixel electrodes 560 are formed in areas surrounded by the scanning lines 561 and the signal lines 562. Note that an alignment layer (not shown) is arranged on the pixel electrodes 560 in an actual liquid crystal display apparatus.

Thin-film transistors 563 each of which includes a source electrode, a drain electrode, a semiconductor layer, and a gate electrode are incorporated in areas surrounded by notch portions of the pixel electrodes 560, the scanning lines 561, and the signal lines 562. When signals are supplied to the scanning lines 561 and the signal lines 562, the thin-film transistors 563 are turned on or off so that power supply to the pixel electrodes 560 is controlled.

Note that although each of the display apparatuses 520, 530, and 550 is configured as a transmissive liquid crystal display apparatus, each of the display apparatuses 520, 530, and 550 may be configured as a reflective liquid crystal display apparatus having a reflective layer or a semi-transmissive liquid crystal display apparatus having a semi-transmissive reflective layer.

Figure 16:
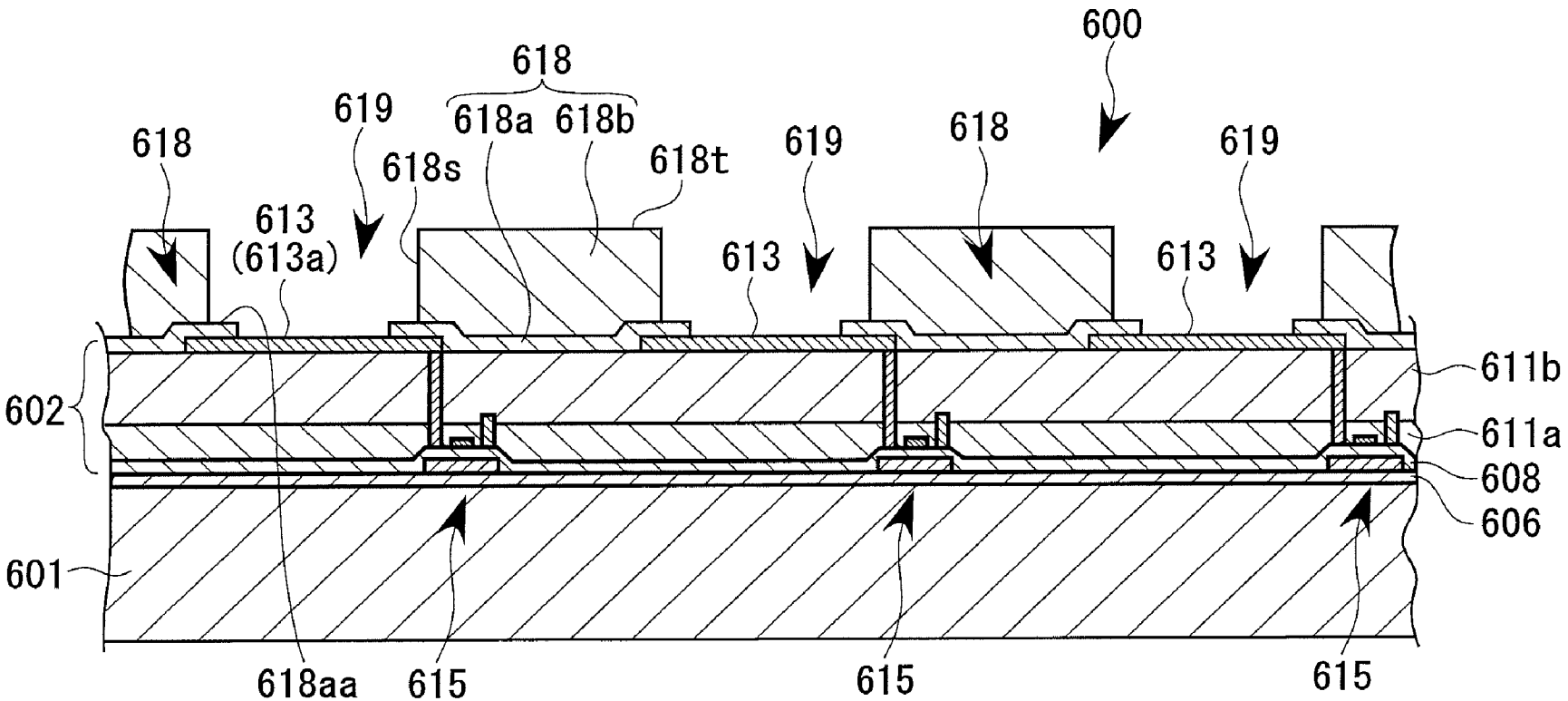
FIG. 16 is a process chart illustrating formation of an organic bank layer.

FIG. 16 is a sectional view illustrating an essential part of a display area of an organic EL apparatus (hereinafter simply referred to as a display apparatus 600).

In this display apparatus 600, a circuit element portion 602, a light-emitting element portion 603, and a cathode 604 are laminated on a substrate (W) 601.

In this display apparatus 600, light is emitted from the light-emitting element portion 603 through the circuit element portion 602 toward the substrate 601 and eventually is emitted to an observer side. In addition, light emitted from the light-emitting element portion 603 toward an opposite side of the substrate 601 is reflected by the cathode 604, and thereafter passes through the circuit element portion 602 and the substrate 601 to be emitted to the observer side.

An underlayer protective film 606 formed of a silicon oxide film is arranged between the circuit element portion 602 and the substrate 601. Semiconductor films 607 formed of polysilicon oxide films are formed on the underlayer protective film 606 (near the light-emitting element portion 603) in an isolated manner. In each of the semiconductor films 607, a source region 607*a* and a drain region 607*b* are formed on the left and right sides thereof, respectively, by high-concentration positive-ion implantation. The center portion of each of the semiconductor films 607 which is not subjected to high-concentration positive-ion implantation serves as a channel region 607*c*.

In the circuit element portion 602, the underlayer protective film 606 and a transparent gate insulating film 608 covering the semiconductor films 607 are formed. Gate electrodes 609 formed of, for example, Al, Mo, Ta, Ti, or W are disposed on the gate insulating film 608 so as to correspond to the channel regions 607*c* of the semiconductor films 607. A first transparent interlayer insulating film 611*a* and a second transparent interlayer insulating film 611*b* are formed on the gate electrodes 609 and the gate insulating film 608. Contact holes 612*a* and 612*b* are formed so as to penetrate the first interlayer insulating film 611*a* and the second interlayer insulating film 611*b* and to be connected to the source region 607*a* and the drain region 607*b* of the semiconductor films 607.

Pixel electrodes 613 which are formed of ITOs, for example, and which are patterned to have a predetermined shape are formed on the second interlayer insulating film 611*b*. The pixel electrode 613 is connected to the source region 607*a* through the contact holes 612*a*.

Power source lines 614 are arranged on the first interlayer insulating film 611*a*. The power source lines 614 are connected through the contact holes 612*b* to the drain region 607*b*.

Figure 13:
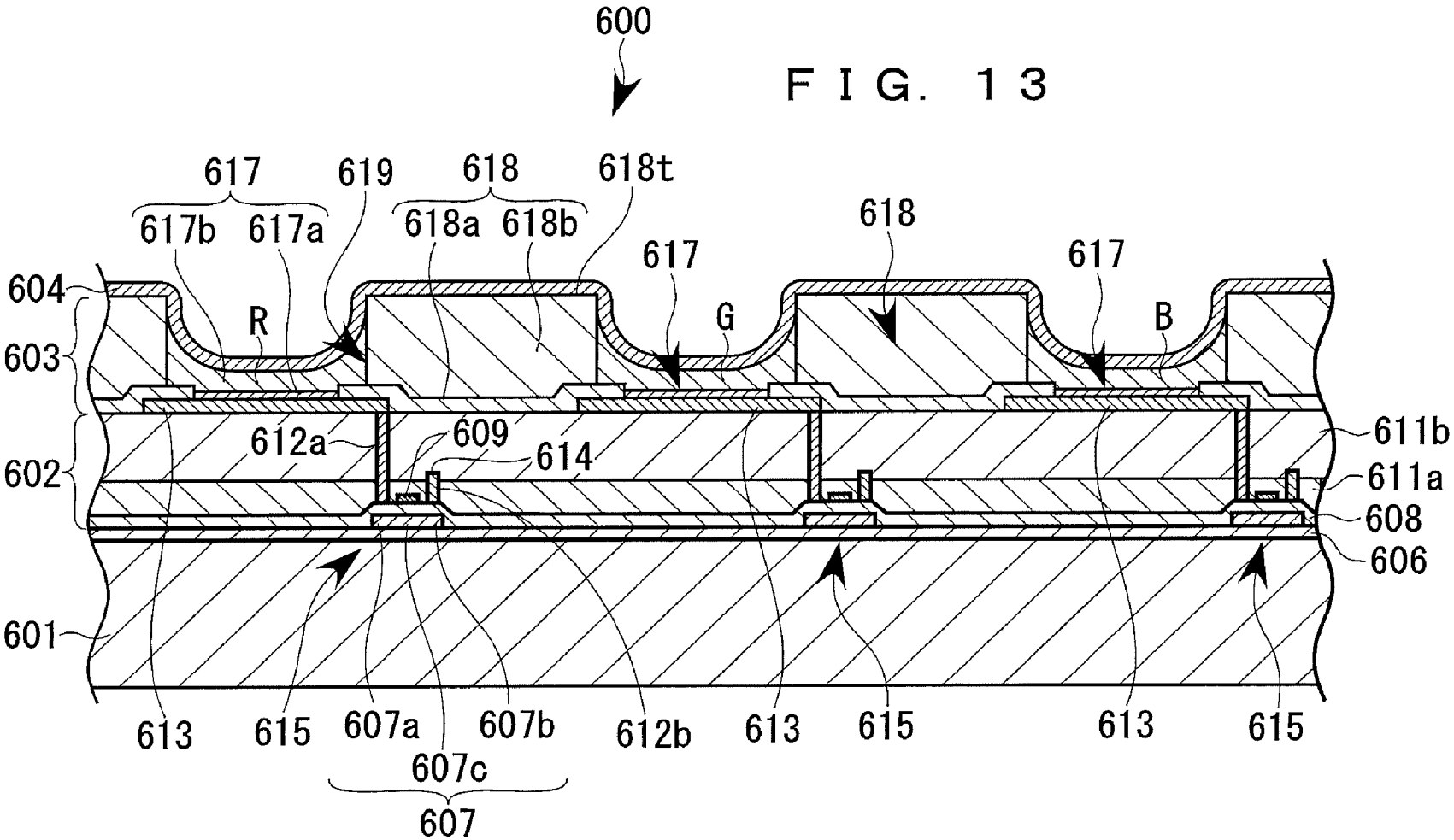
FIG. 13 is a sectional view of an essential part of a display as an organic EL apparatus.

As shown in FIG. 13, the circuit element portion 602 includes thin-film transistors 615 connected to drive the respective pixel electrodes 613.

The light-emitting element portion 603 includes functional layers 617 each formed on a corresponding one of pixel electrodes 613, and bank portions 618 which are formed between the pixel electrodes 613 and the functional layers 617 and which are used to partition the functional layers 617 from one another.

The pixel electrodes 613, the functional layers 617, and the cathode 604 formed on the functional layers 617 constitute the light-emitting element. Note that the pixel electrodes 613 are formed into a substantially rectangular shape in plan view by patterning, and the bank portions 618 are formed so that each two of the pixel electrodes 613 sandwich a corresponding one of the bank portions 618.

Each of the bank portions 618 includes an inorganic bank layer 618*a* (first bank layer) formed of an inorganic material such as SiO, $SiO_2$, or $TiO_2$, and an organic bank layer 618*b* (second bank layer) which is formed on the inorganic bank layer 618*a* and has a trapezoidal shape in a sectional view. The organic bank layer 618*b* is formed of a resist, such as an acrylic resin or a polyimide resin, which has an excellent heat resistance and an excellent lyophobic characteristic. A part of each of the bank portions 618 overlaps peripheries of corresponding two of the pixel electrodes 613 which sandwich each of the bank portions 618.

Openings 619 are formed between the bank portions 618 so as to gradually increase in size upwardly against the pixel electrodes 613.

Each of the functional layers 617 includes a positive-hole injection/transport layer 617*a* formed so as to be laminated on the pixel electrodes 613 and a light-emitting layer 617*b* formed on the positive-hole injection/transport layer 617*a*. Note that another functional layer having another function may be arranged so as to be arranged adjacent to the light-emitting layer 617*b*. For example, an electronic transport layer may be formed.

The positive-hole injection/transport layer 617*a* transports positive holes from a corresponding one of the pixel electrodes 613 and injects the transported positive holes to the light-emitting layer 617*b*. The positive-hole injection/transport layer 617*a* is formed by ejection of a first composition (functional liquid) including a positive-hole injection/transport layer forming material. The positive-hole injection/transport layer forming material may be a known material.

The light-emitting layer 617*b* is used for emission of light having colors red (R), green (G), or blue (B), and is formed by ejection of a second composition (functional liquid) including a material for forming the light-emitting layer 617*b* (light-emitting material). As a solvent of the second composition (nonpolar solvent), a known material which is insoluble to the positive-hole injection/transport layer 617*a* is preferably used. Since such a nonpolar solvent is used as the second composition of the light-emitting layer 617*b*, the light-emitting layer 617*b* can be formed without dissolving the positive-hole injection/transport layer 617*a* again.

The light-emitting layer 617*b* is configured such that the positive holes injected from the positive-hole injection/transport layer 617*a* and electrons injected from the cathode 604 are recombined in the light-emitting layer 617*b* so as to emit light.

The cathode 604 is formed so as to cover an entire surface of the light-emitting element portion 603, and in combination with the pixel electrodes 613, supplies current to the functional layers 617. Note that a sealing member (not shown) is arranged on the cathode 604.

Steps of manufacturing the display apparatus 600 will now be described with reference to FIGS. 14 to 22.

Figure 14:
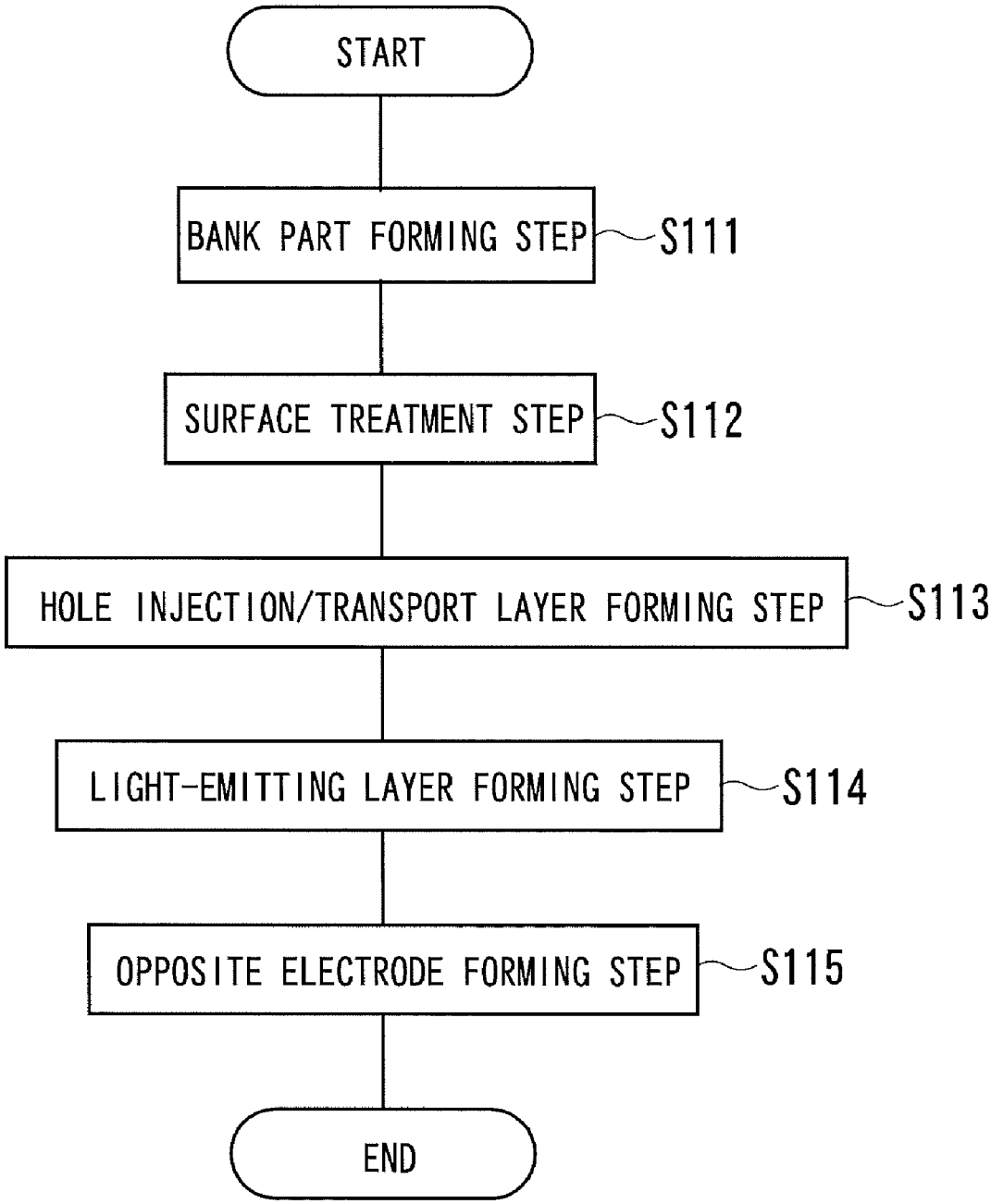
FIG. 14 is a flowchart illustrating manufacturing steps of the display as the organic EL apparatus.

As shown in FIG. 14, the display apparatus 600 is manufactured through a bank portion forming step (S111), a surface processing step (S112), a positive-hole injection/transport layer forming step (S113), a light-emitting layer forming step (S114), and a counter electrode forming step (S115). Note that the manufacturing steps are not limited to these examples shown in FIG. 17, and one of these steps may be omitted or another step may be added according as desired.

Figure 15:
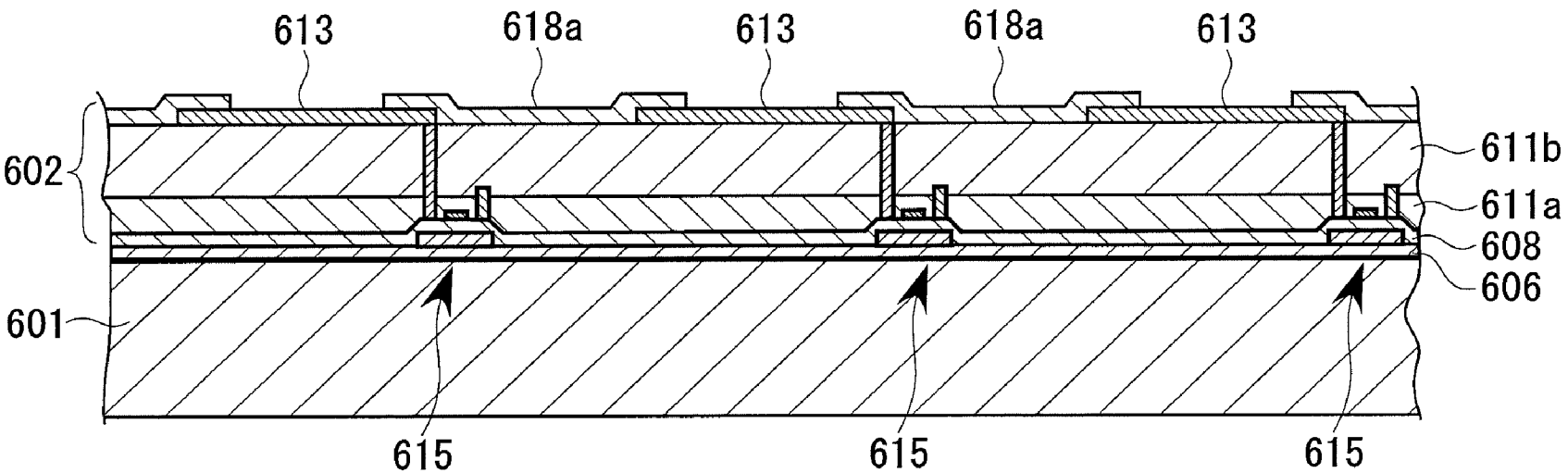
FIG. 15 is a process chart illustrating formation of an inorganic bank layer.

In the bank portion forming step (S111), as shown in FIG. 15, the inorganic bank layers 618*a* are formed on the second interlayer insulating film 611*b*. The inorganic bank layers 618*a* are formed by forming an inorganic film at a desired position and by patterning the inorganic film by the photolithography technique. At this time, a part of each of the inorganic bank layers 618*a* overlaps peripheries of corresponding two of the pixel electrodes 613 which sandwich each of the inorganic bank layers 618*a*.

After the inorganic bank layers 618*a* are formed, as shown in FIG. 16, the organic bank layers 618*b* are formed on the inorganic bank layers 618*a*. As with the inorganic bank layers 618*a*, the organic bank layers 618*b* are formed by patterning a formed organic film by the photolithography technique.

The bank portions 618 are thus formed. When the bank portions 618 are formed, the openings 619 opening upward relative to the pixel electrodes 613 are formed between the bank portions 618. The openings 619 define pixel areas.

In the surface processing step (S112), a hydrophilic treatment and a repellency treatment are performed. The hydrophilic treatment is performed on first lamination areas 618*aa* of the inorganic bank layers 618*a* and electrode surfaces 613*a* of the pixel electrodes 613. The hydrophilic treatment is performed, for example, by plasma processing using oxide as a processing gas on surfaces of the first lamination areas 618*aa* and the electrode surfaces 613*a* to have hydrophilic properties. By performing the plasma processing, the ITO forming the pixel electrodes 613 is cleaned.

The repellency treatment is performed on walls 618*s* of the organic bank layers 618*b* and upper surfaces 618*t* of the organic bank layers 618*b*. The repellency treatment is performed as a fluorination treatment, for example, by plasma processing using tetrafluoromethane as a processing gas on the walls 618*s* and the upper surfaces 618*t*.

By performing this surface processing step, when the functional layers 617 is formed using the functional liquid droplet ejection heads 17, the functional liquid droplets are ejected onto the pixel areas with high accuracy. Furthermore, the functional liquid droplets attached onto the pixel areas are prevented from flowing out of the openings 619.

A display apparatus body 600A is obtained through these steps. The display apparatus body 600A is mounted on the set table 21 of the liquid droplet ejection apparatus 1 shown in FIG. 1 and the positive-hole injection/transport layer forming step (S113) and the light-emitting layer forming step (S114) are performed thereon.

Figure 17:
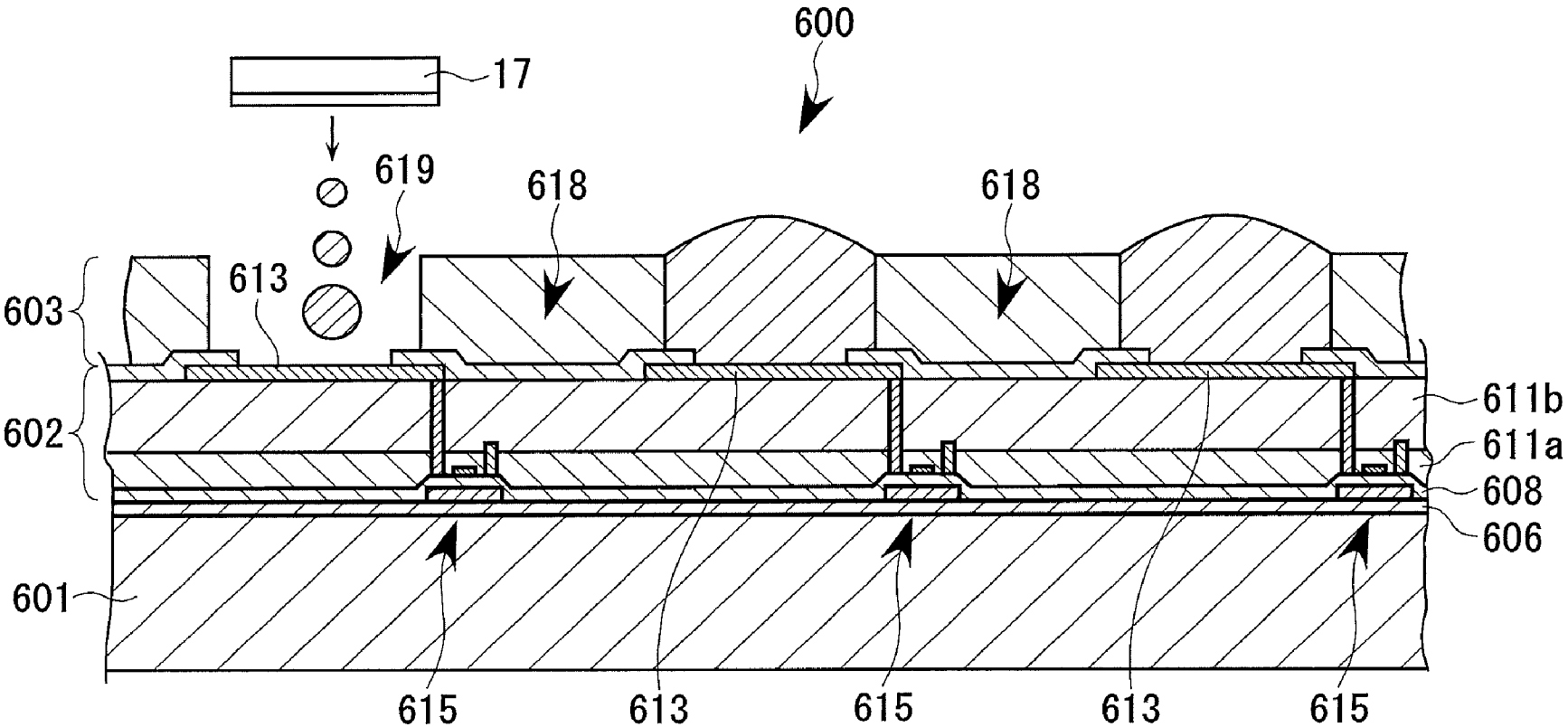
FIG. 17 is a process chart illustrating processes of forming a positive-hole injection/transport layer.
Figure 18:
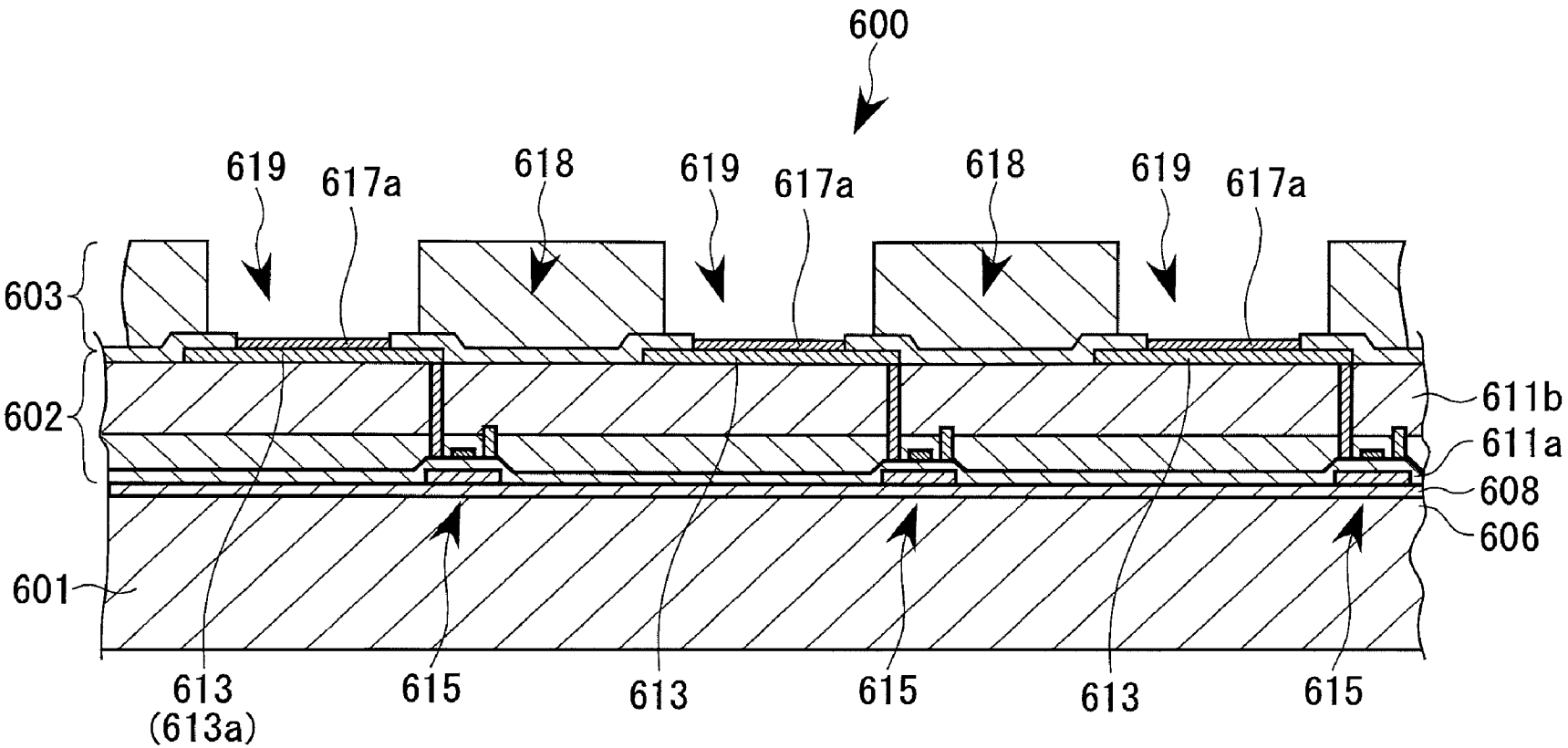
FIG. 18 is a process chart illustrating a state where the positive-hole injection/transport layer has been formed.
Figure 21:
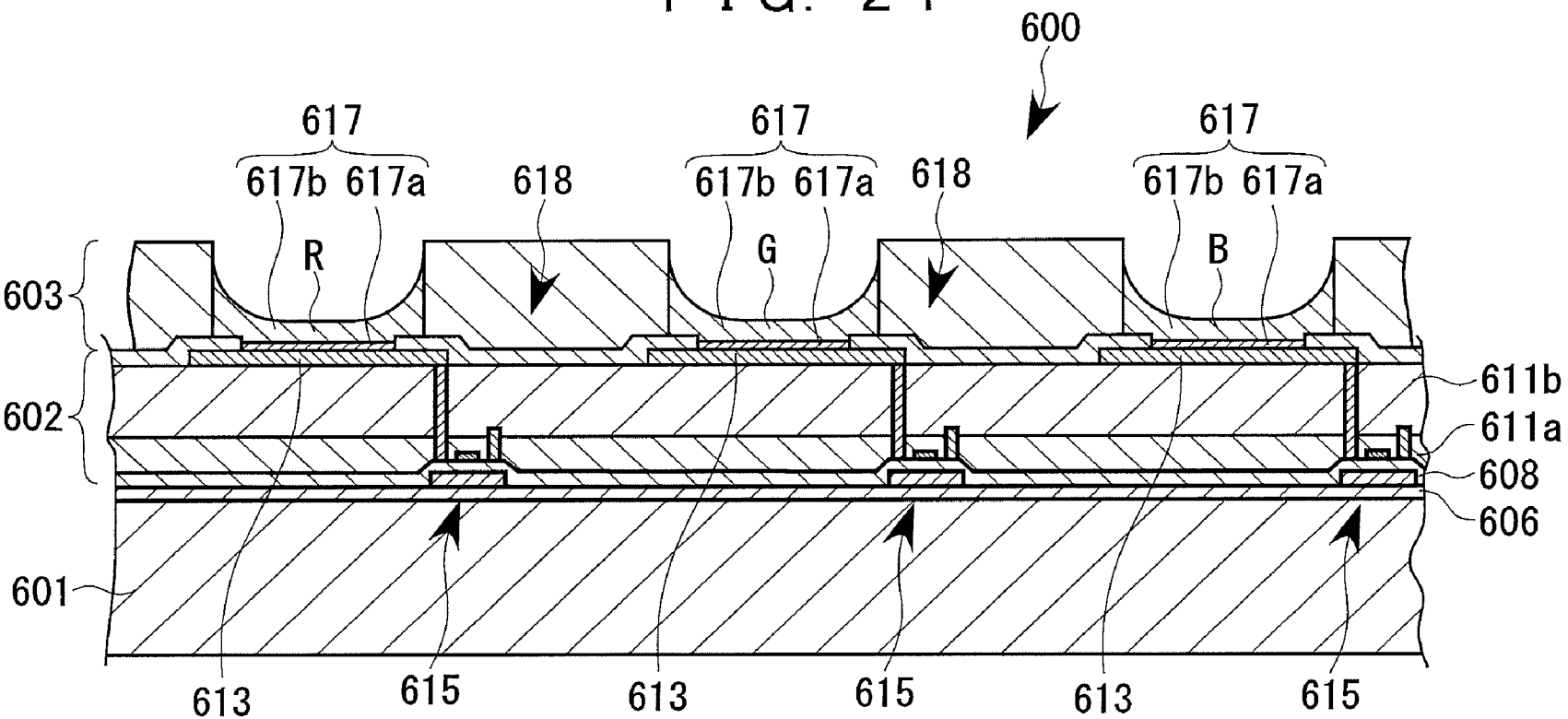
FIG. 21 is a process chart illustrating a state where light-emitting layers having three color components have been formed.

As shown in FIG. 17, in the positive-hole injection/transport layer forming step (S113), the first compositions including the material for forming a positive-hole injection/transport layer are ejected from the functional liquid droplet ejection heads 17 into the openings 619 included in the pixel areas. Thereafter, as shown in FIG. 21, drying processing and a thermal treatment are performed to evaporate polar solution included in the first composition whereby the positive-hole injection/transport layers 617*a* are formed on the pixel electrodes 613 (electrode surface 613*a*).

The light-emitting layer forming step (S114) will now be described. In the light-emitting layer forming step, as described above, a nonpolar solvent which is insoluble to the positive-hole injection/transport layers 617*a* is used as the solvent of the second composition used at the time of forming the light-emitting layer in order to prevent the positive-hole injection/transport layers 617*a* from being dissolved again.

On the other hand, since each of the positive-hole injection/transport layers 617*a* has low affinity to a nonpolar solvent, even when the second composition including the nonpolar solvent is ejected onto the positive-hole injection/transport layers 617*a*, the positive-hole injection/transport layers 617*a* may not be brought into tight contact with the light-emitting layers 617*b* or the light-emitting layers 617*b* may not be uniformly applied.

Accordingly, before the light-emitting layers 617*b* are formed, surface processing (surface improvement processing) is preferably performed so that each of the positive-hole injection/transport layers 617*a* has high affinity to the nonpolar solvent and to the material for forming the light-emitting layers. The surface processing is performed by applying a solvent the same as or similar to the nonpolar solvent of the second composition used at the time of forming the light-emitting layers on the positive-hole injection/transport layers 617*a* and by drying the applied solvent.

Employment of this surface processing allows the surface of the positive-hole injection/transport layers 617*a* to have high affinity to the nonpolar solvent, and therefore, the second composition including the material for forming the light-emitting layers can be uniformly applied to the positive-hole injection/transport layers 617*a* in the subsequent step.

Figure 19:
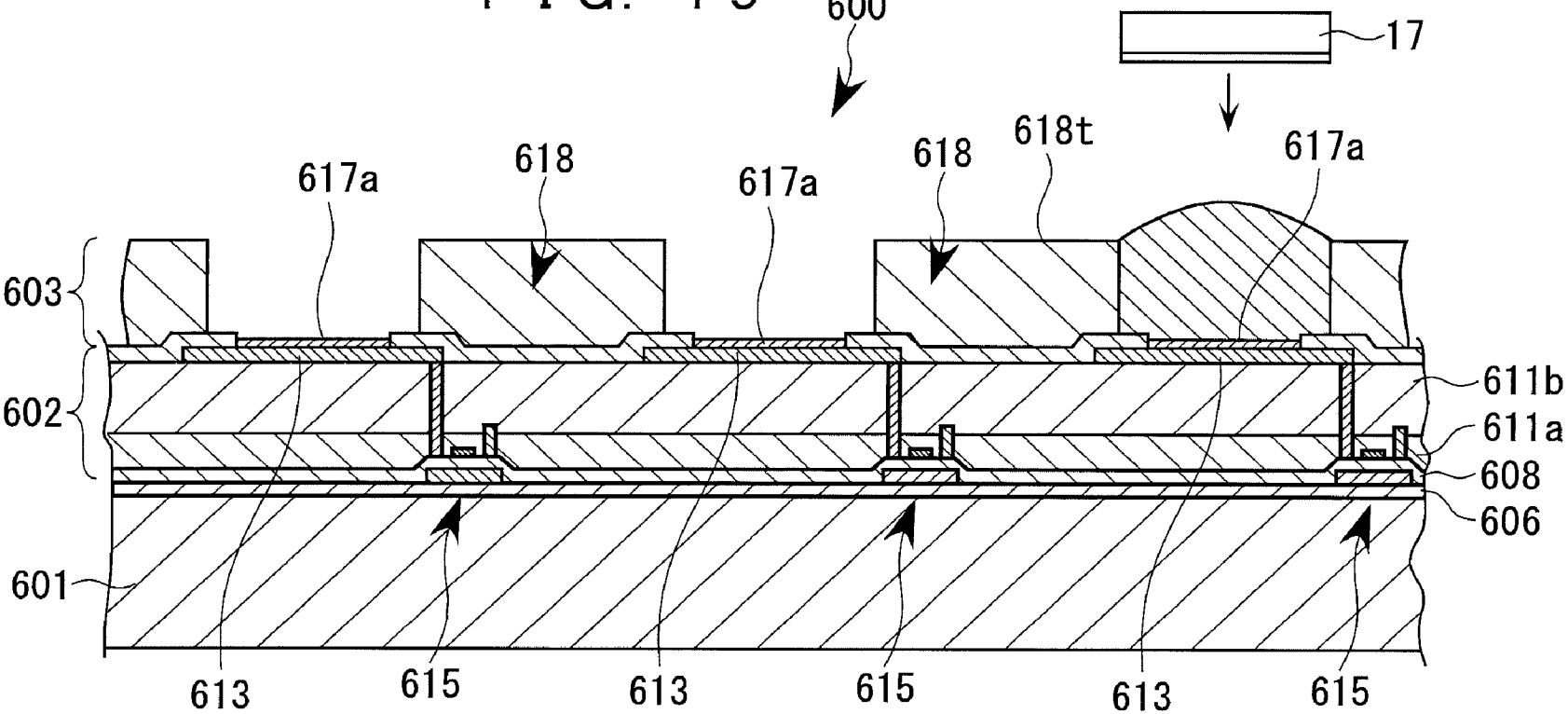
FIG. 19 is a process chart illustrating processes for forming a light-emitting layer having a blue color component.

As shown in FIG. 19, a predetermined amount of second composition including the material for forming the light-emission layers of one of the three colors (blue color (B) in an example of FIG. 19) is ejected into the pixel areas (openings 619) as functional liquid. The second composition ejected into the pixel areas spreads over the positive-hole injection/transport layer 617*a* and fills the openings 619. Note that, even if the second composition is ejected and attached to the upper surfaces 618*t* of the bank portions 618 which are outside of the pixel area, since the repellency treatment has been performed on the upper surfaces 618*t* as described above, the second component easily drops into the openings 619.

Figure 20:
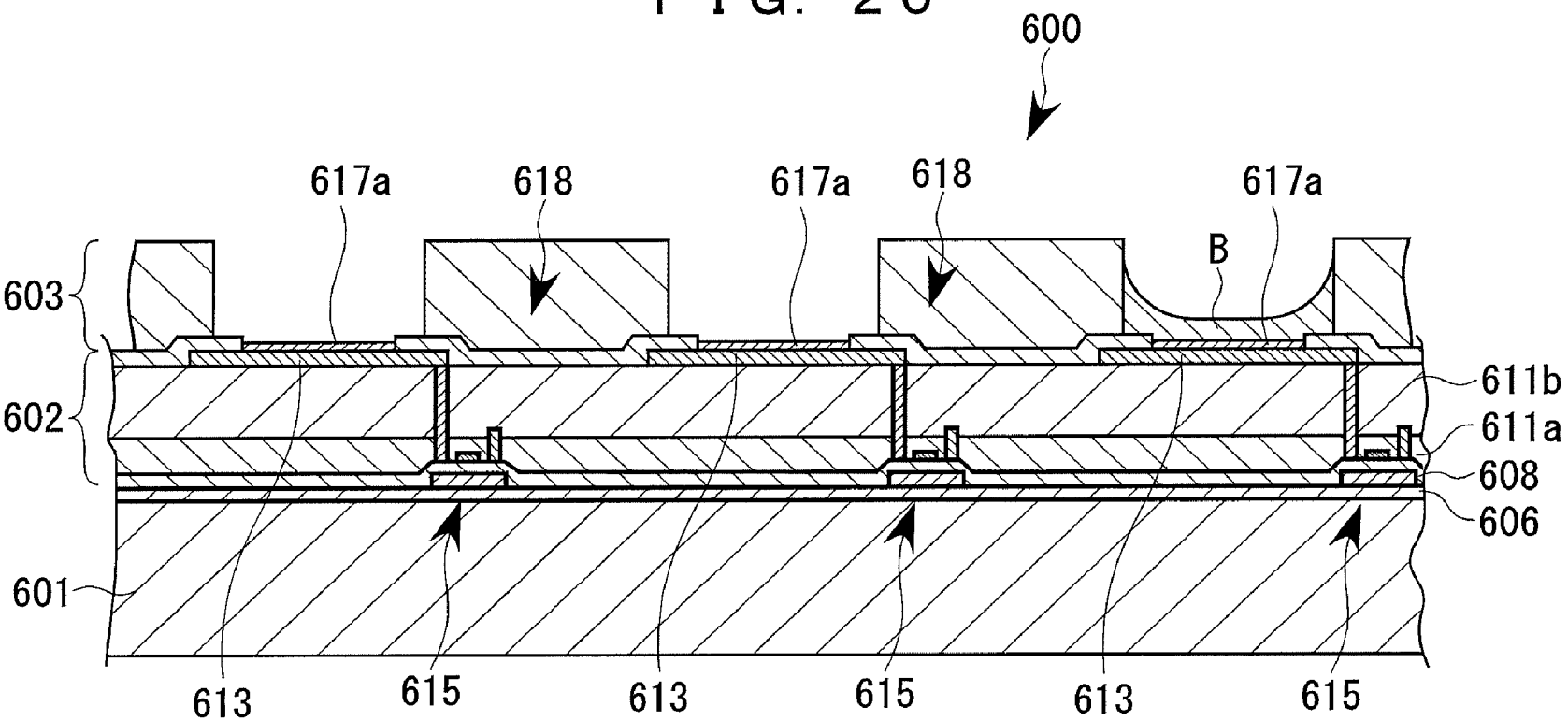
FIG. 20 is a process chart illustrating a state where the light-emitting layer having a blue color component has been formed.

Thereafter, the drying processing is performed so that the ejected second composition is dried and the nonpolar solvent included in the second composition is evaporated whereby the light-emitting layers 617*b* are formed on the positive-hole injection/transport layers 617*a* as shown in FIG. 20. In FIG. 20, one of the light-emitting layers 617*b* corresponding to the blue color (B) is formed.

Similarly, as shown in FIG. 21, a step similar to the above-described step of forming the light-emitting layers 617*b* corresponding to the blue color (B) is repeatedly performed by using functional liquid droplet ejection heads 17 so that the light-emitting layers 617*b* corresponding to other colors (red (R) and green (G)) are formed. Note that the order of formation of the light-emitting layers 617*b* is not limited to the order described above as an example, and any other orders may be applicable. For example, an order of forming the light-emitting layers 617*b* may be determined in accordance with a light-emitting layer forming material. Furthermore, the color scheme pattern of the three colors R, G, and B may be the tripe arrangement, the mosaic arrangement, or the delta arrangement.

As described above, the functional layers 617, that is, the positive-hole injection/transport layers 617*a* and the light-emitting layers 617*b* are formed on the pixel electrodes 613. Then, the process proceeds to the counter electrode forming step (S115).

Figure 22:
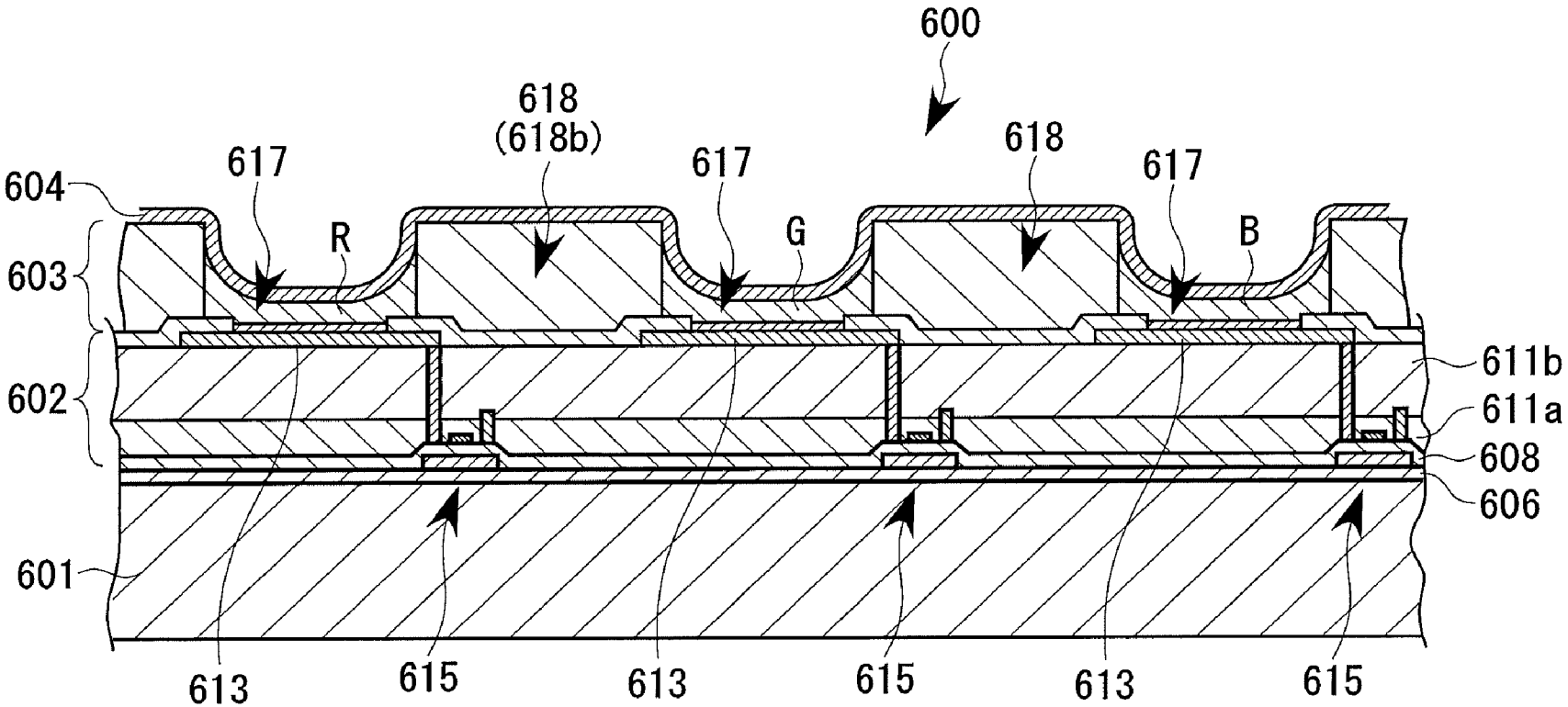
FIG. 22 is a process chart illustrating processes for forming a cathode.

In the counter electrode forming step (S115), as shown in FIG. 22, the cathode (counter electrode) 604 is formed on entire surfaces of the light-emitting layers 617*b* and the organic bank layers 618*b* by an evaporation method, sputtering, or a CVD (chemical vapor deposition) method, for example. The cathode 604 is formed by laminating a calcium layer and an aluminum layer, for example, in this embodiment.

An Al film and a Ag film as electrodes and a protective layer formed of $SiO_2$ or SiN for preventing the Al film and the Ag film from being oxidized are formed on the cathode 604.

After the cathode 604 is thus formed, other processes such as sealing processing of sealing a top surface of the cathode 604 with a sealing member and wiring processing are performed whereby the display apparatus 600 is obtained.

Figure 23:
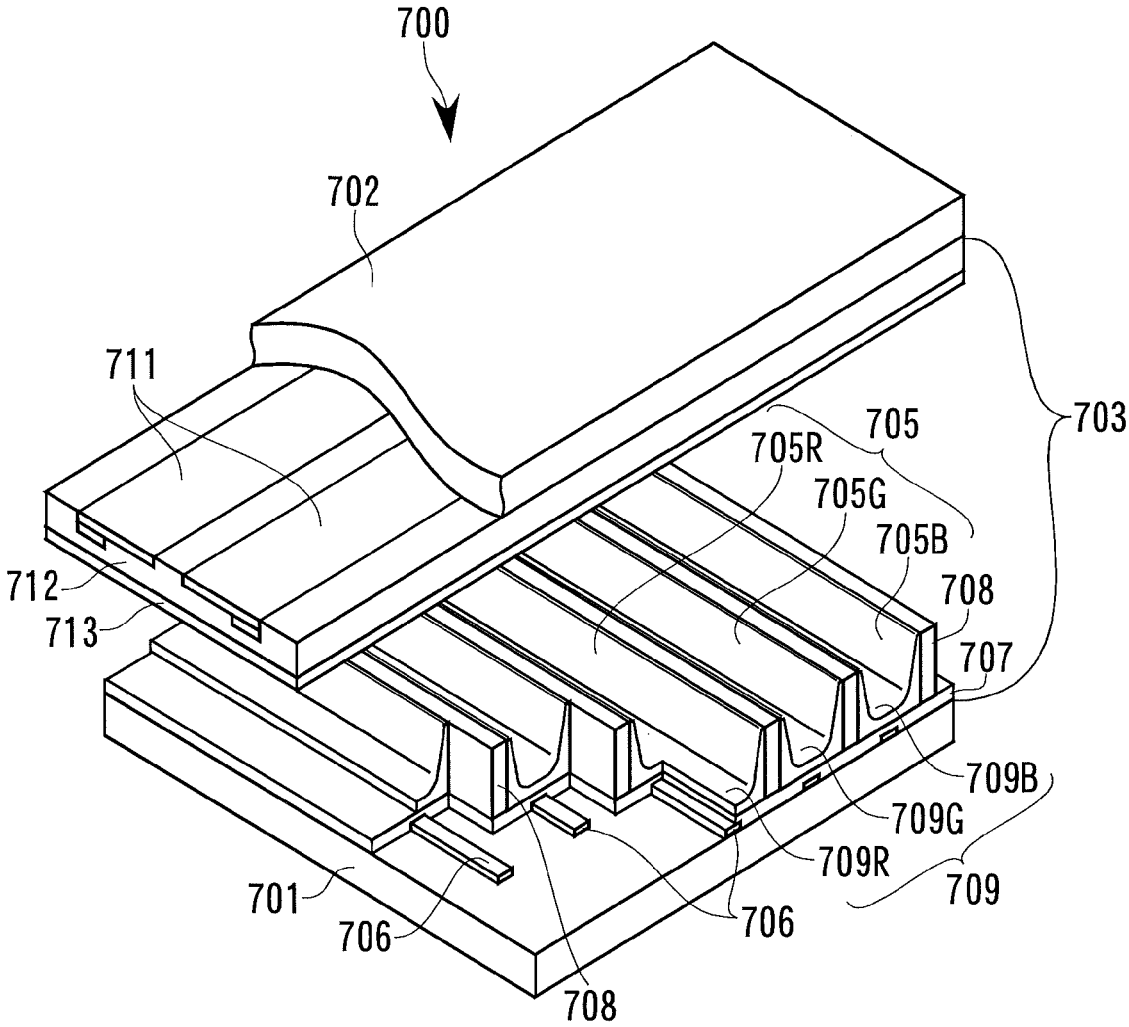
FIG. 23 is a perspective view illustrating an essential part of a plasma display apparatus (PDP apparatus).

FIG. 23 is an exploded perspective view of an essential part of a plasma display apparatus (PDP apparatus: hereinafter simply referred to as a display apparatus 700). Note that, in FIG. 26, the display apparatus 700 is partly cut away.

The display apparatus 700 includes a first substrate 701, a second substrate 702 which faces the first substrate 701, and a discharge display portion 703 interposed therebetween. The discharge display portion 703 includes a plurality of discharge chambers 705. The discharge chambers 705 include red discharge chambers 705R, green discharge chambers 705G, and blue discharge chambers 705B, and are arranged so that one of the red discharge chambers 705R, one of the green discharge chambers 705G, and one of the blue discharge chambers 705B constitute one pixel as a group.

Address electrodes 706 are arranged on the first substrate 701 with predetermined intervals therebetween in a stripe pattern, and a dielectric layer 707 is formed so as to cover top surfaces of the address electrodes 706 and the first substrate 701. Partition walls 708 are arranged on the dielectric layer 707 so as to be arranged along with the address electrodes 706 in a standing manner between the adjacent address electrodes 706. Some of the partition walls 708 extend in a width direction of the address electrodes 706 as shown in FIG. 26, and the others (not shown) extend perpendicular to the address electrodes 706.

Regions partitioned by the partition walls 708 serve as the discharge chambers 705.

The discharge chambers 705 include respective fluorescent substances 709. Each of the fluorescent substances 709 emits light having one of the colors of red (R), green (G) and blue (B). The red discharge chamber 705R has a red fluorescent substance 709R on its bottom surface, the green discharge chamber 705G has a green fluorescent substance 709G on its bottom surface, and the blue discharge chamber 705B has a blue fluorescent substance 709B on its bottom surface.

On a lower surface of the second substrate 72 in FIG. 23, a plurality of display electrodes 711 are formed with predetermined intervals therebetween in a stripe manner in a direction perpendicular to the address electrodes 706. A dielectric layer 712 and a protective film 713 formed of MgO, for example, are formed so as to cover the display electrodes 711.

The first substrate 701 and the second substrate 702 are attached so that the address electrodes 706 are arranged perpendicular to the display electrodes 711. Note that the address electrodes 706 and the display electrodes 711 are connected to an alternate power source (not shown).

When the address electrodes 706 and the display electrodes 711 are brought into conduction states, the fluorescent substances 709 are excited and emit light whereby display with colors is achieved.

In this embodiment, the address electrodes 706, the display electrodes 711, and the fluorescent substances 709 may be formed using the liquid droplet ejection apparatus 1 shown in FIG. 1. Steps of forming the address electrodes 706 on the first substrate 701 are described hereinafter.

The steps are performed in a state where the first substrate 701 is mounted on the set table 21 on the liquid droplet ejection apparatus 1.

The functional liquid droplet ejection heads 17 eject a liquid material (functional liquid) including a material for forming a conducting film wiring as functional liquid droplets to be attached onto regions for forming the address electrodes 706. The material for forming a conducting film wiring included in the liquid material is formed by dispersing conductive fine particles such as those of a metal into dispersed media. Examples of the conductive fine particles include a metal fine particle including gold, silver, copper, palladium, or nickel, and a conductive polymer.

When ejection of the liquid material onto all the desired regions for forming the address electrodes 706 is completed, the ejected liquid material is dried, and the disperse media included in the liquid material is evaporated whereby the address electrodes 706 are formed.

Although the steps of forming the address electrodes 706 are described as an example above, the display electrodes 711 and the fluorescent substances 709 may be formed by the steps described above.

In a case where the display electrodes 711 are formed, as with the address electrodes 706, a liquid material (functional liquid) including a material for forming a conducting film wiring is ejected from the functional liquid droplet ejection heads 17 as liquid droplets to be attached to the areas for forming the display electrodes.

In a case where the fluorescent substances 709 are formed, a liquid material including fluorescent materials corresponding to three colors (R, G, and B) is ejected as liquid droplets from the functional liquid droplet ejection heads 17 so that liquid droplets having the three colors (R, G, and B) are attached within the discharge chambers 705.

Figure 24:
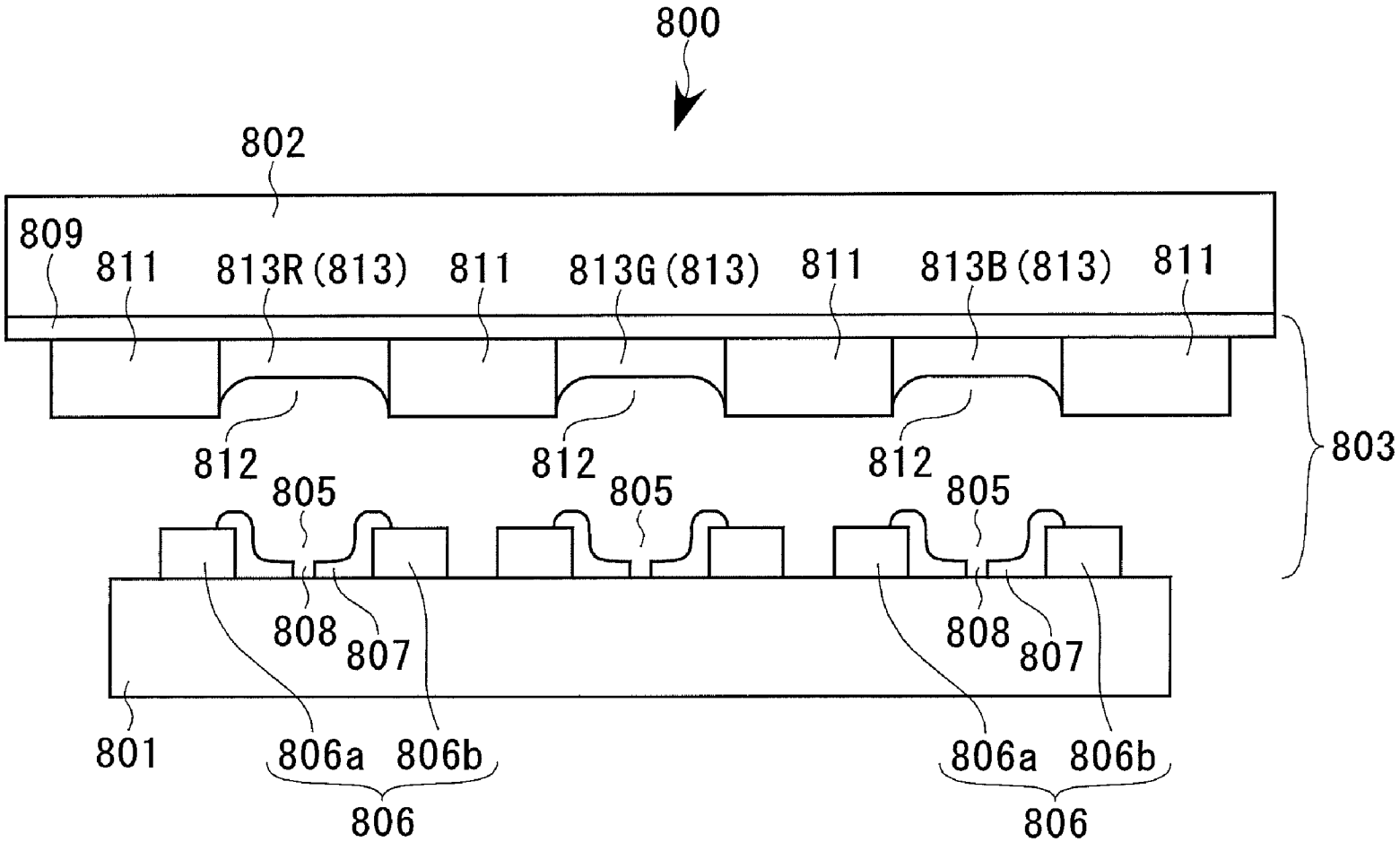
FIG. 24 is a sectional view illustrating an essential part of an electron emission display apparatus (FED apparatus).

FIG. 24 shows a sectional view of an essential part of an electron emission apparatus (also referred to as a FED apparatus or a SED apparatus: hereinafter simply referred to as a display apparatus 800). In FIG. 24, a part of the display apparatus 800 is shown in the sectional view.

The display apparatus 800 includes a first substrate 801, a second substrate 802 which faces the first substrate 801, and a field-emission display portion 803 interposed therebetween. The field-emission display portion 803 includes a plurality of electron emission portions 805 arranged in a matrix.

First element electrodes 806*a* and second element electrodes 806*b*, and conductive films 807 are arranged on the first substrate 801. The first element electrodes 806*a* and the second element electrodes 806*b* intersect with each other. Cathode electrodes 806 are formed on the first substrate 801, and each of the cathode electrodes 806 is constituted by one of the first element electrodes 806*a* and one of the second element electrodes 806*b*. In each of the cathode electrodes 806, one of the conductive films 807 having a gap 808 is formed in a portion formed by the first element electrode 806*a* and the second element electrode 806*b*. That is, the first element electrodes 806*a*, the second element electrodes 806*b*, and the conductive films 807 constitute the plurality of electron emission portions 805. Each of the conductive films 807 is constituted by palladium oxide (PdO). In each of the cathode electrodes 806, the gap 808 is formed by forming processing after the corresponding one of the conductive films 807 is formed.

An anode electrode 809 is formed on a lower surface of the second substrate 802 so as to face the cathode electrodes 806. A bank portion 811 is formed on a lower surface of the anode electrode 809 in a lattice. Fluorescent materials 813 are arranged in opening portions 812 which opens downward and which are surrounded by the bank portion 811. The fluorescent materials 813 correspond to the electron emission portions 805. Each of the fluorescent materials 813 emits fluorescent light having one of the three colors, red (R), green (G), and blue (B). Red fluorescent materials 813R, green fluorescent materials 813G, and blue fluorescent materials 813B are arranged in the opening portions 812 in a predetermined arrangement pattern described above.

The first substrate 801 and the second substrate 802 thus configured are attached with each other with a small gap therebetween. In this display apparatus 800, electrons emitted from the first element electrodes 806*a* or the second element electrodes 806*b* included in the cathode electrodes 806 hit the fluorescent materials 813 formed on the anode electrode 809 so that the fluorescent materials 813 are excited and emit light whereby display with colors is achieved.

As with the other embodiments, in this case also, the first element electrodes 806*a*, the second element electrodes 806*b*, the conductive films 807, and the anode electrode 809 may be formed using the liquid droplet ejection apparatus 1. In addition, the red fluorescent materials 813R, the green fluorescent materials 813G, and the blue fluorescent materials 813B may be formed using the liquid droplet ejection apparatus 1.

Figure 25A:
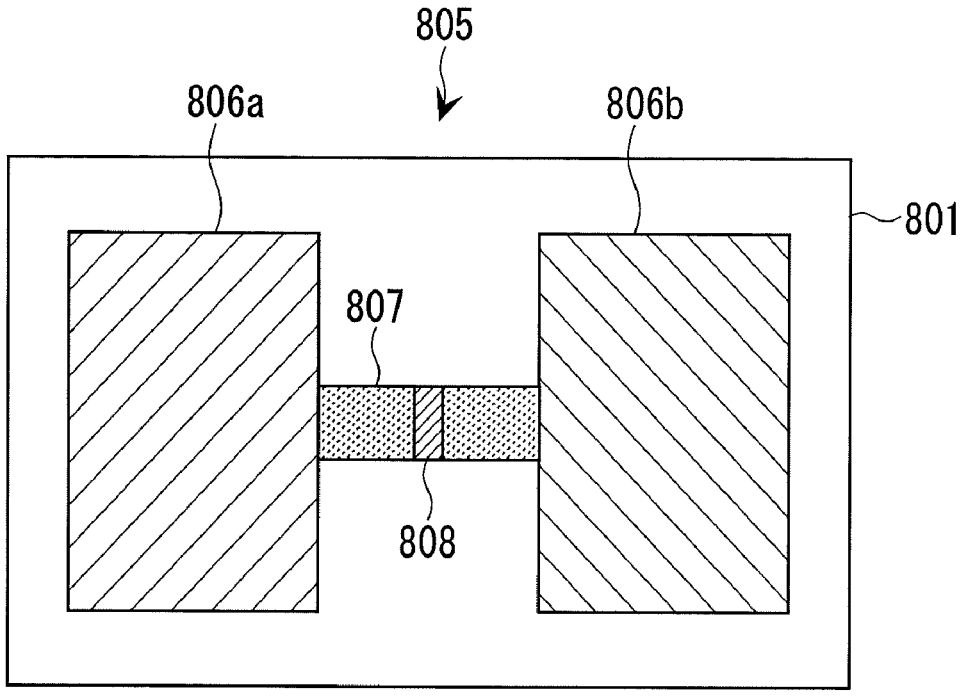
FIG. 25A is a plan view illustrating an electron emission portion and the vicinity thereof of a display apparatus.
Figure 25B:
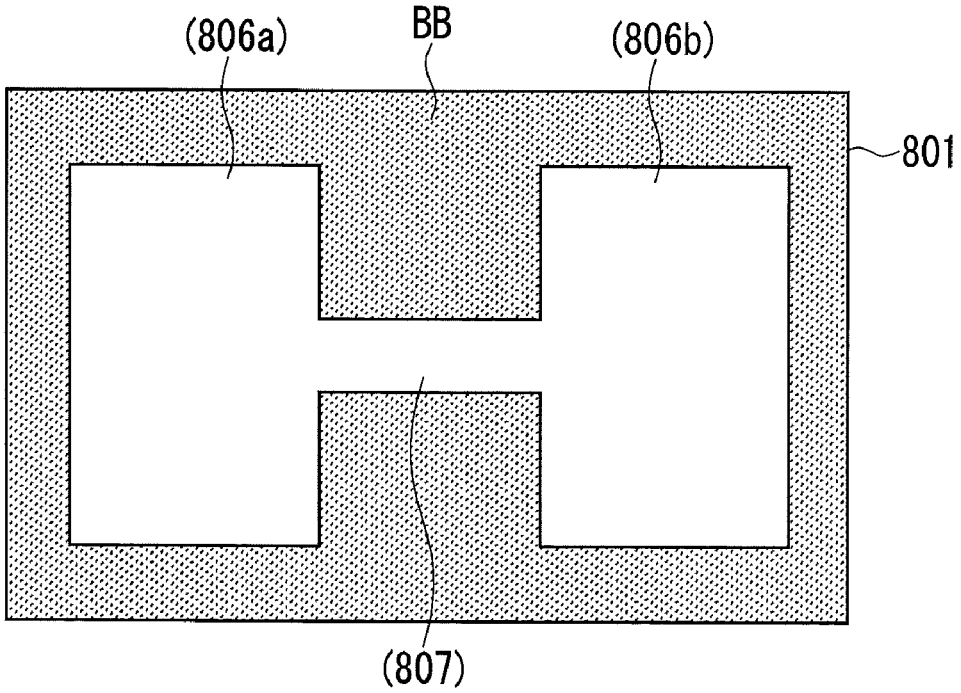
FIG. 25B is a plan view illustrating a method of forming the electron emission portion and the vicinity thereof.

Each of the first element electrodes 806*a*, each of the second element electrodes 806*b*, and each of the conductive films 807 have shapes as shown in FIG. 25A. When the first element electrodes 806*a*, the second element electrodes 806*b*, and the conductive films 807 are formed, portions for forming the first element electrodes 806*a*, the second element electrodes 806*b*, and the conductive films 807 are left as they are on the first substrate 801 and only bank portions BB are formed (by a photolithography method) as shown in FIG. 25B. Then, the first element electrodes 806*a* and the second element electrodes 806*b* are formed by an inkjet method using a solvent ejected from the liquid droplet ejection apparatus 1 in grooves defined by the bank portions BB and are formed by drying the solvent. Thereafter, the conductive films 807 are formed by the inkjet method using the liquid droplet ejection apparatus 1. After forming the conductive films 807, the bank portions BB are removed by ashing processing and the forming processing is performed. Note that, as with the case of the organic EL device, the hydrophilic treatment is preferably performed on the first substrate 801 and the second substrate 802 and the repellency treatment is preferably performed on the bank portion 811 and the bank portions BB.

Examples of other electro-optical apparatuses include an apparatus for forming metal wiring, an apparatus for forming a lens, an apparatus for forming a resist, and an apparatus for forming an optical diffusion body. Use of the liquid droplet ejection apparatus 1 makes it possible to efficiently manufacture various electro-optical apparatuses.

What is claimed is:

1. A method for arranging liquid droplet ejection heads, the method comprising:

arranging and fixing a plurality of inkjet liquid droplet ejection heads, ejecting a common functional liquid, on a common carriage plate, based on the amount of liquid droplets ejected from a number of ejecting nozzles in a nozzle row that each of the liquid droplet ejection heads has, with the heads shifted in a direction of the nozzle row, the liquid droplet ejection heads being so arranged and fixed that in the liquid droplet ejection heads closely aligned in the direction of the nozzle row, a difference between the amounts of liquid droplets ejected from two ejection nozzles located at each innermost end of the liquid droplet ejection heads is within a predetermined range of tolerance, and the amounts of liquid droplets ejected from two ejection nozzles located at the outermost ends in the direction of the nozzle row on the carriage plate are within a predetermined range of a reference amount.

2. The method for arranging liquid droplet ejection heads according to claim 1, wherein the liquid droplet ejection heads arranged on the carriage plate are selected from candidate liquid droplet ejection heads to be arranged whose number is greater than the number of the liquid droplet ejection heads arranged on the carriage plate.

3. The method for arranging liquid droplet ejection heads according to claim 2, wherein the candidate liquid droplet ejection heads has a fluctuation in the amounts of liquid droplets ejected from all the ejection nozzles within a predetermined range.

4. The method for arranging liquid droplet ejection heads according to claim 1, wherein the liquid droplet ejection heads are divided into two head groups in the direction of the nozzle row and arranged on the carriage plate, and the liquid droplet ejection heads belonging to one head group and the liquid droplet ejection heads belonging to the other head group face each other in the direction of the nozzle row.

5. The method for arranging liquid droplet ejection heads according to claim 1, wherein the functional liquid has either color of red, green, or blue, and the predetermined range of tolerance is determined based on the difference between the amounts of liquid droplets ejected to avoid unevenness of color possibly generated when liquid droplets ejected and landed from two ejection nozzles are adjacent to each other.

6. The method for arranging liquid droplet ejection heads according to claim 1, wherein the functional liquid has either color of red, green, or blue, and the predetermined range of the reference amount is a range having a standardized amount of liquid droplets ejected from a single ejection nozzle as a mean value, and determined based on a range of the amount of liquid droplets ejected to avoid unevenness of color in any of the ejected and landed adjacent liquid droplets.

7. The method for arranging liquid droplet ejection heads according to claim 1, wherein when two or more sets of alternatives exist within the predetermined range of the reference amount, an alternative is selected with which the sum of the square of the difference between the mean value in the range of the reference amount and the amount of liquid droplets ejected from one of the above-mentioned two ejection nozzles in each set and the square of the difference between the mean value in the range of reference amount and the amount of liquid droplets ejected from the other of the above-mentioned two ejection nozzles in each set is the minimum.

8. The method for arranging liquid droplet ejection heads according to claim 1, wherein on a premise that the average amount of liquid droplets ejected in each nozzle row is the absolute target amount of liquid droplets ejected, the amount of liquid droplets ejected is compared using a numeric value normalized with the absolute target amount of liquid droplets ejected defined as 1.

9. The method for arranging liquid droplet ejection heads according to claim 1, wherein the amount of liquid droplets ejected from a number of ejection nozzles in each nozzle row is calculated from an approximate characteristic line based on measurement results.

10. The method for arranging liquid droplet ejection heads according to claim 9, wherein the approximate characteristic line is derived from the results obtained by measuring the amount of liquid droplets from all of a plurality of ejection nozzles located at both ends of a number of ejection nozzles and by excluding the amount of liquid droplets from a plurality of remaining ejection nozzles located in an intermediate part.

11. The method for arranging liquid droplet ejection heads according to claim 1, wherein the amount of liquid droplets ejected used when comparing whether to be in within the range of tolerance is the average value of the amounts of liquid droplets ejected from the ejection nozzles located at the ends of a number of ejection nozzles.

12. The method for arranging liquid droplet ejection heads according to claim 1, wherein the amount of liquid droplets ejected used when comparing whether to be in within the range of the reference amount is the average value of the amounts of liquid droplets ejected from the ejection nozzles located at the ends of a number of ejection nozzles.

13. The method for arranging liquid droplet ejection heads according to claim 1, wherein each liquid droplet ejection head has a plurality of ineffective ejection nozzles not used for drawing at both ends of a number of ejection nozzle in each nozzle row.

14. A head unit comprising:

a plurality of liquid droplet ejection heads are arranged and fixed on a carriage plate by the method for arranging liquid droplet ejection heads as claimed in claim 1.

15. A liquid droplet ejection apparatus comprising:

the head unit as claimed in claim 14 to eject a functional liquid to a workpiece for drawing.

16. A method for manufacturing an electro-optical apparatus, the method comprising:

forming a film with functional liquid droplets on a workpiece with the liquid droplet ejection apparatus as claimed in claim 15.

17. An electro-optical apparatus comprising:

a film formed on a workpiece with functional liquid droplets with the liquid droplet ejection apparatus as claimed in claim 15.

18. An electronic device comprising:

an electro-optical apparatus manufactured by the method for manufacturing an electro-optical apparatus as claimed in claim 16.

19. An electronic device comprising the electro-optical apparatus as claimed in claim 17.

* * * * *